US009839110B2

(12) United States Patent
Kim et al.

(10) Patent No.: US 9,839,110 B2
(45) Date of Patent: Dec. 5, 2017

(54) PLASMA LIGHT SOURCE APPARATUS AND LIGHT SOURCE SYSTEM INCLUDING THE SAME

(71) Applicant: SAMSUNG ELECTRONICS CO., LTD., Suwon-si, Gyeonggi-do (KR)

(72) Inventors: Wook-Rae Kim, Suwon-si (KR); Won-Don Joo, Incheon (KR); Byeong-Hwan Jeon, Yongin-si (KR); Sung-Hwi Cho, Gwangju-si (KR); Young-Kyu Park, Incheon (KR); Jung-Chul Lee, Yongin-si (KR); Jin-Woo Ahn, Suwon-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 15/222,571

(22) Filed: Jul. 28, 2016

(65) Prior Publication Data

US 2017/0111986 A1 Apr. 20, 2017

(30) Foreign Application Priority Data

Oct. 20, 2015 (KR) ..... 10-2015-0146095

(51) Int. Cl.

| | |
|---|---|
| ***H01J 5/16*** | (2006.01) |
| ***H01K 1/30*** | (2006.01) |
| ***H05H 1/46*** | (2006.01) |
| ***H05G 2/00*** | (2006.01) |
| ***H05H 1/24*** | (2006.01) |

(52) U.S. Cl.

CPC ..... *H05H 1/46* (2013.01); *H05G 2/00* (2013.01); *H05H 1/24* (2013.01); *H05H 2240/00* (2013.01)

(58) Field of Classification Search

USPC ..... 250/372, 459.1, 461.1, 493.1, 492.1, 250/492.2, 494.1, 495.1, 505.1, 50, 4 R, 250/526; 378/119, 143

See application file for complete search history.

(56) References Cited

U.S. PATENT DOCUMENTS

| | | | | |
|---|---|---|---|---|
| 7,880,153 | B2 | 2/2011 | Suganuma et al. | |
| 8,198,613 | B2 | 6/2012 | Moriya et al. | |
| 8,259,771 | B1 | 9/2012 | Shchemelinin et al. | |
| 8,368,041 | B2 | 2/2013 | Graham et al. | |
| 8,575,575 | B2 | 11/2013 | Partlo et al. | |
| 8,723,147 | B2 | 5/2014 | Abhari et al. | |
| 8,841,824 | B2 * | 9/2014 | Ko | H01J 65/04 250/306 |
| 9,052,615 | B2 | 6/2015 | Nishisaka et al. | |

(Continued)

FOREIGN PATENT DOCUMENTS

| | | |
|---|---|---|
| JP | 08-327794 | 12/1996 |
| JP | 10-311801 | 11/1998 |
| JP | 2005-188929 | 7/2005 |

*Primary Examiner* — Bernard Souw

(74) *Attorney, Agent, or Firm* — F. Chau & Associates, LLC

(57) ABSTRACT

A plasma light source apparatus includes a first laser generator configured to generate a first laser. A second laser generator is configured to generate a second laser. A chamber is configured to accommodate and seal a medium material for plasma ignition and to allow plasma to be ignited by the first laser and to be maintained by the second laser. An inner surface of the chamber includes two curved mirrors that face each other.

20 Claims, 23 Drawing Sheets

(56) References Cited

U.S. PATENT DOCUMENTS

| | | | | |
|---|---|---|---|---|
| 9,305,764 | B2 * | 4/2016 | Park | G02B 27/141 |
| 9,374,883 | B2 * | 6/2016 | Park | H05G 2/003 |
| 9,425,036 | B2 * | 8/2016 | Kim | H01J 61/025 |
| 9,702,826 | B2 * | 7/2017 | Hashimoto | G01N 21/8806 |
| 2011/0122387 | A1 | 5/2011 | Tao et al. | |
| 2015/0163893 | A1 | 6/2015 | Park et al. | |

* cited by examiner

PLASMA LIGHT SOURCE APPARATUS AND LIGHT SOURCE SYSTEM INCLUDING THE SAME

CROSS-REFERENCE TO RELATED APPLICATION

This application claims the benefit of Korean Patent Application No. 10-2015-0146095, filed on Oct. 20, 2015, in the Korean Intellectual Property Office, the disclosure of which is incorporated by reference herein in its entirety.

TECHNICAL FIELD

The inventive concept relates to a light source apparatus, and more particularly, to a plasma light source apparatus and a light source system including the same.

A light source apparatus may be used in providing light exposure or light analysis. Such light source apparatuses are required to emit light having an emission intensity in a desired wavelength band. The light source apparatuses must also have a long lifespan. An example of a suitable light source for exposure or analysis is a laser-driven or induced plasma light source apparatus. A laser-induced plasma light source apparatus generates plasma by applying a high voltage/high current to a gas enclosed in a bulb that is formed of quartz. The plasma is maintained within the bulb by utilizing laser light from an external laser beam. In this way, plasma light having a desired emission intensity and spectrum distribution is provided. Such a plasma light source apparatus may require the use of an electrode for applying a high voltage/high current into a bulb. An expensive elliptical mirror is also used to efficiently emit light. It is also difficult to emit high-brightness light as increasing a plasma temperature, given a structure and a material of the bulb, may be difficult.

SUMMARY

The inventive concept provides a plasma light source apparatus having high efficiency and high brightness. The plasma light source may efficiently collect and provide a laser, may efficiently collect and give off plasma light, and may efficiently cool a light source apparatus.

The inventive concept also provides a light source system that may provide plasma light having high efficiency and high brightness by combining plasma light from at least two plasma light source apparatuses.

According to an aspect of the inventive concept, a plasma light source apparatus is provided. The apparatus includes a first laser generator configured to generate a first laser beam. A second laser generator is configured to generate a second laser beam. A chamber is configured to accommodate and seal a medium material for plasma ignition. The chamber has an inner surface including two curved mirrors that face each other. Plasma in the chamber is ignited by the first laser beam and is maintained by the second laser beam.

According to an aspect of the inventive concept, a light source system includes at least two light source apparatuses. A light-combining optical device is configured to combine plasma light output from the at least two plasma light source apparatuses. Each of the at least two plasma light source apparatuses includes a chamber configured to accommodate and seal a medium material for plasma ignition. The chamber has an inner surface including two curved mirrors that face each other. Plasma in the chamber is ignited by a first laser beam and is maintained by a second laser beam.

BRIEF DESCRIPTION OF THE DRAWINGS

Embodiments of the inventive concept will be more clearly understood from the following detailed description taken in conjunction with the accompanying drawings in which.

DETAILED DESCRIPTION OF THE EMBODIMENTS

Figure 1:
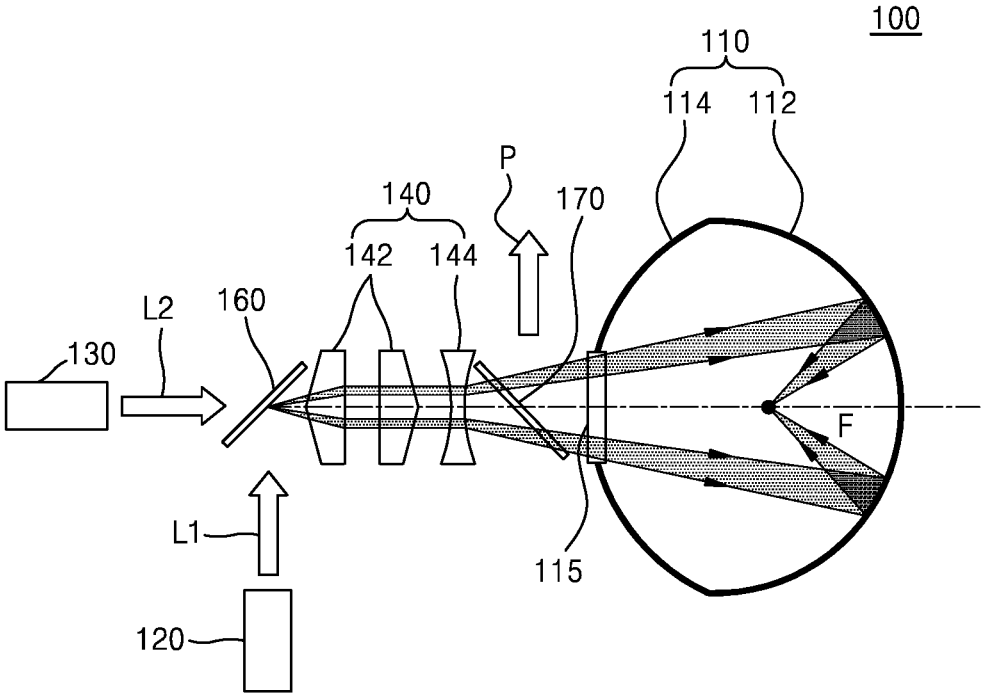
FIG. 1 is a view illustrating a plasma light source apparatus according to an exemplary embodiment of the present invention.

The inventive concept now will be described more fully hereinafter with reference to the accompanying drawings, in which elements of the inventive concept are shown. The inventive concept may, however, be embodied in many different forms and should not be construed as limited to the exemplary embodiments set forth herein.

It will be understood that when an element is referred to as being "connected" or "coupled" to another element, it can be directly connected or coupled to the other element or intervening elements may be present. Also, in the drawings, structures or sizes of elements may be exaggerated for convenience of explanation and clarity. In the drawings, the same reference numerals may denote the same elements in different figures.

Figure 2A:
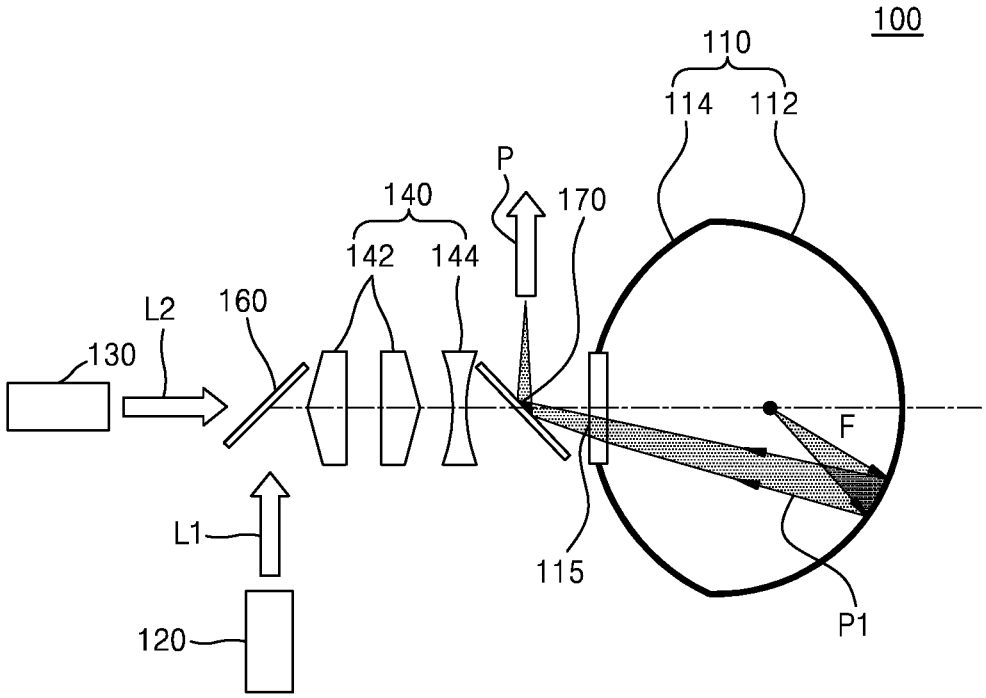
FIGS. 2A and 2B are views illustrating a process for outputting plasma light performed by the plasma light source apparatus of FIG. 1, according to exemplary embodiments of the present invention.
Figure 2B:
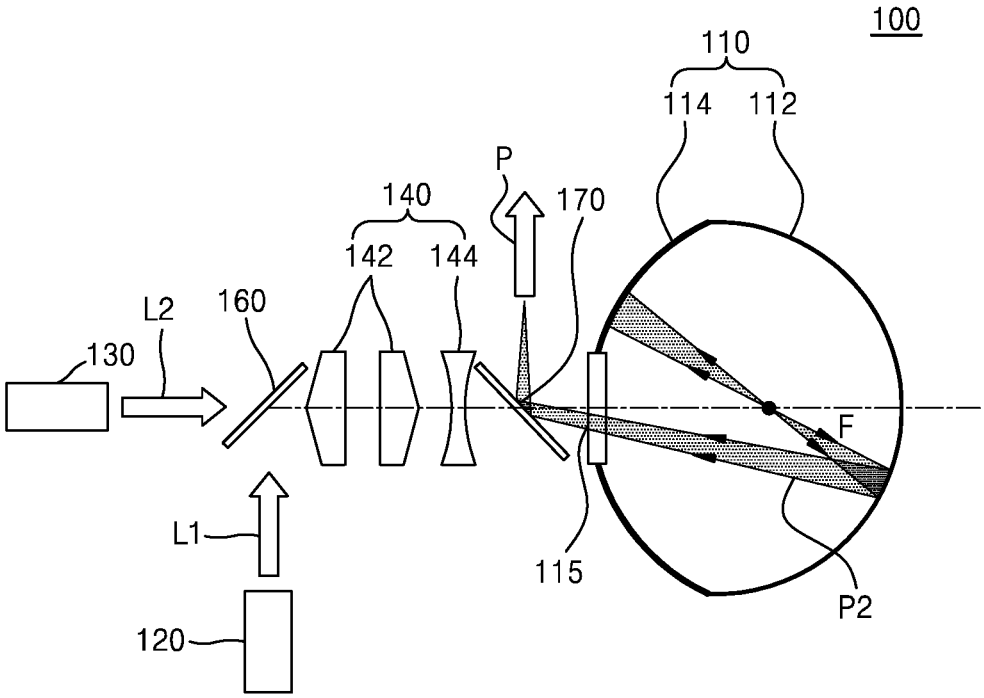

FIG. 1 is a view illustrating a plasma light source apparatus 100 according to an exemplary embodiment of the present invention. FIGS. 2A and 2B are views illustrating a process of providing plasma light.

Referring to FIG. 1, a plasma light source apparatus 100 may include a chamber 110, a first laser generator 120, a second laser generator 130, a first lens array 140, a first dichroic mirror 160, and a second dichroic mirror 170.

The chamber 110 may accommodate a medium material for plasma ignition. For example, the medium material for plasma ignition may be in the form of a solid, a liquid, or a gas. The medium material for plasma ignition may be sealed within the chamber 110. The medium material for plasma ignition may be referred to as an ionizable medium material.

The chamber 110 may include at least one of, for example, a dielectric material, pyrex, quartz, suprasil quartz, sapphire, $MgF_2$, diamond, and $CaF_2$. The chamber 110 may be formed of an appropriate substance for containing the medium material for plasma ignition, for allowing lasers to be provided to the chamber 110, and for generating plasma light in the chamber 110.

The chamber 110 may accommodate any of various materials as the medium material for plasma ignition. For example, the medium material for plasma ignition may be at least one of, for example, noble gas, xenon (Xe), argon (Ar), neon (Ne), krypton (Kr), helium (He), $D_2$, $H_2$, $O_2$, $F_2$, a metal, halide halogen, a halogen, mercury (Hg), cadmium (Cd), zinc (Zn), tin (Sn), gallium (Ga), iron (Fe), lithium (Li), sodium (Na), an excimer forming gas, air, a vapour, a metal oxide, an aerosol, a flowing medium, and a recycled medium. However, the present embodiment is not limited thereto, and a solid or liquid target may be formed in the chamber 110. The medium material for plasma ignition may be generated in the chamber 110 by using the target. For example, the medium material for plasma ignition may be generated by exposing the target in the chamber 110 with a laser beam. The target may be a metal pool or a metal film. The target may be a solid or liquid target (e.g., a liquid droplet) that moves in the chamber 110.

The medium material for plasma ignition may be introduced into the chamber 110. The chamber 110 may then be sealed. The medium material for plasma ignition may then be used to ignite plasma, for example, using a first laser beam L1. Once the plasma is ignited, the plasma may be maintained at a maximum state by energy supplied from a second laser beam L2. For example, the first laser beam L1 may be a pulse laser and the second laser beam L2 may be a continuous wave (CW) laser. However, types of the first laser beam L1 and the second laser beam L2 are not limited thereto.

Thus, according to exemplary embodiments of the present invention, plasma ignition may be performed using the first laser beam L1 and plasma maintenance may be performed using the second laser beam L2. This process will be explained in more detail below as the first laser generator 120 and the second laser generator 130 are described. In the chamber 110, since plasma is ignited by using the first laser beam L1, an additional electrode does not need to be provided in the chamber 110. Accordingly, the plasma light source apparatus 100 may be a plasma light source apparatus using an electrodeless lamp or an electrodeless chamber.

In the plasma light source apparatus 100, an inner surface of the chamber 110 may include a curved mirror. For example, the inner surface of the chamber 110 may have a double curved mirror structure in which two curved mirrors are coupled to each other in such a way that the two mirrors face each other. As shown in FIG. 1, one curved mirror may be an elliptical mirror 112 and the other mirror may be a spherical mirror 114. The elliptical mirror 112 may have a shape that is a section of a three-dimensional (3D) ellipsoidal object, such as an egg. The spherical mirror 114 may have a shape that is a section of a 3D sphere. Accordingly, in the plasma light source apparatus 100 of an exemplary embodiment of the present invention, the chamber 110 may include the elliptical mirror 112 and the spherical mirror 114. The elliptical mirror 112 and the spherical mirror 114 may increase efficiency of providing the first laser beam L1 and the second laser beam L2 to the chamber 110 and may increase the efficiency of emitting plasma light P generated in the chamber 110.

Regarding the elliptical mirror, light output from one focal point is reflected by the elliptical mirror and travels to another focal point. Regarding the spherical mirror, light incident at an angle that is parallel to an optical axis is reflected by the spherical mirror and travels to a focal point located on the optical axis. Light incident past the focal point is reflected by the spherical mirror and travels in a direction that is parallel to the optical axis. Also, light incident past a spherical center of the spherical mirror is reflected by the spherical mirror and travels back to the spherical center. This geometry of light is illustrated by the arrows depicted within the chamber 110 in FIG. 1.

The elliptical mirror 112 and the spherical mirror 114 may each be formed of a material and having a structure for reflecting electromagnetic waves. For example, an inner surface of each of the elliptical mirror 112 and the spherical mirror 114 may be formed of a material such as pyrax or quartz. An outer surface of each of the elliptical mirror 112 and the spherical mirror 114 may be formed of a metal material. If necessary, an optical coating may be applied to the inner surface of each of the elliptical mirror 112 and the spherical mirror 114 and thus each of the elliptical mirror 112 and the spherical mirror 114 may reflect or transmit electromagnetic waves within desired wavelength bands. Also, the elliptical mirror 112 and the spherical mirror 114 may each be dichroic mirrors that may reflect or transmit light to a different extent according to its wavelengths.

In order to increase the efficiency of providing the first laser beam L1 and the second laser beam L2 to the chamber 110 and in order to increase the efficiency of outputting the plasma light P from the chamber 110, the elliptical mirror 112 and the spherical mirror 114 may be coupled to each other with appropriate curvatures, as determined according to the law of reflection for the elliptical mirror and the spherical mirror. For example, a focal point F of the elliptical mirror 112 that is close to the elliptical mirror 112 may be the same as a focal point of a spherical center (or a center of curvature) of the spherical mirror 114.

A window 115 having the shape of a flat panel may be disposed on the spherical mirror 114, for example, as shown in FIG. 1. The first laser beam L1 and the second laser beam L2, having passed through the window 115, may be provided into the chamber 110 and the plasma light P may be directed from the chamber 110 through the window 115. Accordingly, the window 115 may be formed of a material, such as pyrax or quartz, through which most electromagnetic waves may be transmitted.

The first laser generator 120 may generate the first laser beam L1, for example, a visible pulse laser, and may provide the first laser beam L1 to the chamber 110. However, the first laser beam L1 generated by the first laser generator 120 is not limited to a visible light pulse laser. For example, the first laser beam L1 generated by the first laser generator 120 may be a pulse laser having any of various wavelengths, for example, an infrared wavelength or an ultraviolet wavelength.

Peak power of the first laser beam L1 generated by the first laser generator 120 may be very high. For example, the first laser beam L1 provided to the chamber 110 may have peak power high enough to ignite plasma in the chamber 110. Also, since the first laser beam L1 is used only to ignite plasma, average power may be low and a time taken for the first laser beam L1 to be provided to the chamber 110 may be short. Accordingly, an emission intensity of the plasma ignited by the first laser beam L1 may be low. The first laser beam L1 may be continuously provided to the chamber 110 for a predetermined period of time after the plasma is ignited.

The second laser generator 130 may generate the second laser beam L2, for example, an infrared (IR) continuous wave (CW) laser, and may provide the second laser beam L2 to the chamber 110. However, the second laser beam L2 generated by the second laser generator 130 is not limited to an IR CW laser. For example, the second laser beam L2 may be a CW laser having a wavelength other than an infrared wavelength.

The second laser beam L2 generated by the second laser generator 130 may be provided to the chamber 110 to maintain the plasma in an ignited state and increase the ignited plasma to high power. Accordingly, the second laser beam L2 may be a high power CW laser having energy high enough to maintain the plasma and increase an intensity of the plasma.

The first lens array 140 converts the first laser beam L1 and the second laser beam L2 provided thereto into beams having ring shapes such as doughnut-like shapes. The first lens array 140 may include, for example, an axicon lens 142 pair and a concave lens 144. The concave lens 144 may allow a beam having a ring shape to appear to be provided from a far focal point from among two focal points of the elliptical mirror 112. A beam having a ring shape may be formed using devices other than the axicon lens 142, for example, a spatial light modulator (SLM).

The first lens array 140 is not limited to a combination of the axicon lens 142 and the concave lens 144. For example, in order to increase efficiency of forming the first laser beam L1 and the second laser beam L2 and providing the first laser beam L1 and the second laser beam L2, the first lens array 140 may include various lenses.

The first dichroic mirror 160 may reflect the first laser beam L1 provided from the first laser generator 120 to the chamber 110 and may transmit the second laser beam L2 provided from the second laser generator 130 to the chamber 110. The first dichroic mirror 160 may be disposed in a direction in which laser beams of the first laser generator 120 and the second laser generator 130 are emitted and may be disposed so that the first laser generator 120 and the second laser generator 130 may maintain a predetermined angle therebetween according to reflection and transmission characteristics of the first dichroic mirror 160. For example, the first laser generator 120 and the second laser generator 130 may be disposed to maintain an angle of about 90° therebetween when the first dichroic mirror 160 is used as a vertex. Also, the first dichroic mirror 160 may be disposed to have a gradient of about 45° with respect to a direction (referred to as a travel direction) in which each of the first laser beam L1 and the second laser beam L2 travels. An angle between the first laser generator 120 and the second laser generator 130 may be changed, and in this case, a gradient of the dichroic mirror 160 may also be changed.

In addition, the first dichroic mirror 160 may transmit the first laser beam L1 and may reflect the second laser beam L2 by changing the reflection and transmission characteristics of the first dichroic mirror 160. In this case, positions of the first laser generator 120 and the second laser generator 130 may be exchanged with each other.

The second dichroic mirror 170 may be disposed between the first lens array 140 and the chamber 110, and may transmit both the first laser beam L1 and the second laser beam L2 to the chamber 110. For example, the first laser beam L1 and the second laser beam L2 may enter the chamber 110 through the window 115 of the spherical mirror 114. Also, the second dichroic mirror 170 may reflect the plasma light P emitted from the chamber 110 to a target optical system. The target optical system may be, for example, a rod lens or a homogenizer. For example, the plasma light P corresponding to ultraviolet (UV) light may be emitted from the chamber 110 and may be directly reflected by the second dichroic mirror 170 to the homogenizer. For example, the homogenizer may be an optical mechanism for spatially homogenizing light, and may be included as one of the elements of the plasma light source apparatus 100. Alternatively, the homogenizer may be an independent element that is separate from the plasma light source apparatus 100. For example, when the homogenizer is not included as an element of the plasma light source apparatus 100, the plasma light P reflected by the second dichroic mirror 170 may be an output of the plasma light source apparatus 100. In contrast, when the homogenizer is included as an element of the plasma light source apparatus 100, the plasma light P having passed through the homogenizer may be an output of the plasma light source apparatus 100.

The homogenizer may be disposed to have an angle of about 90° with respect to the chamber 110 when the second dichroic mirror 170 is used as a vertex. The second dichroic mirror 170 may be disposed to have a gradient of about 45° with respect to a travel direction of each of the first laser beam L1, the second laser beam L2, and the plasma light P based on reflection and transmission characteristics. However, an angle of the homogenizer may be changed, and in this case, a gradient of the second dichroic mirror 170 may also be changed.

In addition, the second dichroic mirror 170 may reflect the first laser beam L1 and the second laser beam L2 and may transmit the plasma light P by changing the reflection and transmission characteristics of the second dichroic mirror 170. For example, positions of the first laser generator 120, the second laser generator 130, and the homogenizer may be changed.

For example, the dichroic mirrors may be formed by combining a plurality of thin film materials with different refractive indices, and the dichroic mirrors may reflect light having a certain wavelength and may transmit light having other wavelengths. Dichroic mirrors have relatively low absorption loss, as compared to a general color filter, and the use of dichroic mirrors may increase or reduce a wavelength range of light that is selected and reflected according to a thickness or a structure of the constituent materials.

A process of inputting and collecting the first laser beam L1 and the second laser beam L2 by using the elliptical mirror 112 and the spherical mirror 114 in the plasma light source apparatus 100 in accordance with an exemplary embodiment of the present invention will now be briefly explained.

The first laser beam L1 is provided to the chamber 110 by being reflected by the first dichroic mirror 160 and by being transmitted through the second dichroic mirror 170. The first laser beam L1 may be converted into a beam having a ring shape by the first lens array 140 and then may be provided to the chamber 110. The first laser beam L1 may be provided to the chamber 110, and then may be collected on the focal point F of the elliptical mirror 112 by being reflected by the elliptical mirror 112, to ignite plasma. For example, the first laser beam L1 having passed through the first lens array 140 may appear to have been provided from a far focal point of the elliptical mirror 112. Also, due to the law of reflection of the elliptical mirror, the first laser beam L1, having passed through the far focal point, may be provided to and collected on the focal point F, that is a close focal point, by being reflected by the elliptical mirror 112.

The second laser beam L2 is provided to the chamber 110 by being transmitted through the first dichroic mirror 160 and the second dichroic mirror 170. The second laser beam L2 may be converted into a beam having a ring shape by the first lens array 140 and then may be provided to the chamber 110. The second laser beam L2 may be provided into the chamber 110, and then may be collected on the focal point F of the elliptical mirror 112 by being reflected by the elliptical mirror 112, to maintain plasma and increase an intensity of the plasma.

The first laser beam L1, for example, a pulse laser, and the second laser beam L2, for example, a CW laser, may be collected and overlaid on the same point in the chamber 110. This same point may be, for example, the focal point F of the elliptical mirror 112. The two laser beams L1 and L2 may be collected and overlaid by virtue of being reflected by the elliptical mirror 112. Accordingly, plasma having high power may be generated and maintained. Also, even when the pulse laser is stopped after the plasma having high power is generated, since energy is supplied by the CW laser, the plasma may be maintained and an intensity of the plasma may be increased.

As described above, plasma is ignited by using the first laser beam L1, for example, a pulse laser. However, in the plasma light source apparatus 100 according to an exemplary embodiment of the present invention, an ignition source used to ignite plasma is not limited to a pulse laser. For example, any of various other ignition sources such as a microwave ignition source, a UV ignition source, a capacitive discharge ignition source, an inductive discharge ignition source, a high frequency ignition source, a flash lamp ignition source, or a pulse lamp ignition source may be used. In addition, when a discharge ignition source is used, an electrode may be provided in the chamber 110.

Referring to FIGS. 2A and 2B, in the plasma light source apparatus 100 of FIG. 1, plasma may be generated on the focal point F of the elliptical mirror 112 by the first laser beam L1 and may then be maintained by the second laser beam L2, as described above. As shown in FIG. 2A, plasma light P1, emitted by plasma generated on the focal point F of the elliptical mirror 112, may travel to the elliptical mirror 112, may be reflected by the elliptical mirror 112, may pass through the window 115, and may be discharged from the chamber 110. The plasma light P1 discharged to the outside of the chamber 110 may be reflected by the second dichroic mirror 170 to the homogenizer. P and P1 denote the same plasma light. However, P denotes final plasma light as it is discharged from the plasma light source apparatus 100 and P1 denotes plasma light before it is discharged.

As shown in FIG. 2B, plasma light P2 emitted by plasma generated on the focal point F of the elliptical mirror 112 may travel to the spherical mirror 114. As described above, a spherical center of the spherical mirror 114 and the focal point F of the elliptical mirror 112 may be the same. Accordingly, the plasma light P2 reflected by the spherical mirror 114 may travel back to the spherical center of the spherical mirror 114. For example, the plasma light P2 may pass through the focal point F of the elliptical mirror 112, and may then be reflected by the elliptical mirror 112. The plasma light P2 reflected by the elliptical mirror 112 may pass through the window 115, may then be discharged from the chamber 110, and may then be reflected by the second dichroic mirror 170 to the homogenizer.

In some plasma light source apparatuses, plasma light is provided using only an elliptical mirror or a spherical mirror. Part of the plasma light travelling backward may be collected by, for example, the elliptical mirror whereas part of the plasma light travelling frontward might not be collected, thereby greatly reducing output efficiency. However, in the plasma light source apparatus 100 according to an exemplary embodiment of the present invention, since the chamber 110 includes the elliptical mirror 112 and the spherical mirror 144 that are coupled to each other such that they face each other, both parts of the plasma light P travelling backward and frontward may be collected and output, thereby maximizing efficiency of outputting the plasma light P.

The plasma light source apparatus 100 according to exemplary embodiments of the present invention may ignite plasma, may maintain the plasma and may increase an intensity of the plasma by using the first laser beam L1 and the second laser beam L2 in the chamber 110. The chamber 110 may have a relatively large space therein. Accordingly, problems caused when plasma is formed in a narrow bulb-type lamp formed of quartz may be solved. For example, narrow bulb-type lamps formed of quartz may be damaged at a high temperature and a high pressure and may therefore have a shorter lifespan than is desired. Also, when attempting to enlarge the size of the narrow bulb-type lamps, a thickness of the bulb is increased. This increased thickness may reduce the transmittance of light, and the efficiency of collecting a laser, and accordingly, the efficiency of generating plasma and collecting plasma light may be reduced. However, according to the plasma light source apparatus 100 of exemplary embodiments of the present invention, since the chamber 110, having a large space instead of a narrow bulb, is used as a lamp at a high pressure and the chamber 110, that is an optical system, may collect light given off by plasma, problems associated with narrow bulb-type lamps, for example, damage and a short lifespan, may be solved. For example, since the risk of damage caused by high temperature and high pressure is very low, an expected lifespan of the plasma light source apparatus 100 may be tens of thousands of hours, and since such a bulb does not need to be replaced, the plasma light source apparatus 100 may be non-removable.

Also, since the plasma light source apparatus 100 according to exemplary embodiments of the present invention uses the chamber 110 which includes the elliptical mirror 112 and the spherical mirror 114 that are coupled to each other such that they face each other, a laser for generating and maintaining the plasma may be efficiently provided and collected, and plasma light having high brightness may be efficiently collected and discharged from the chamber 110. Accordingly, a plasma light source apparatus 100 according to exemplary embodiments of the present invention may have high brightness due to maximized efficiency of collecting plasma light.

Figure 3:
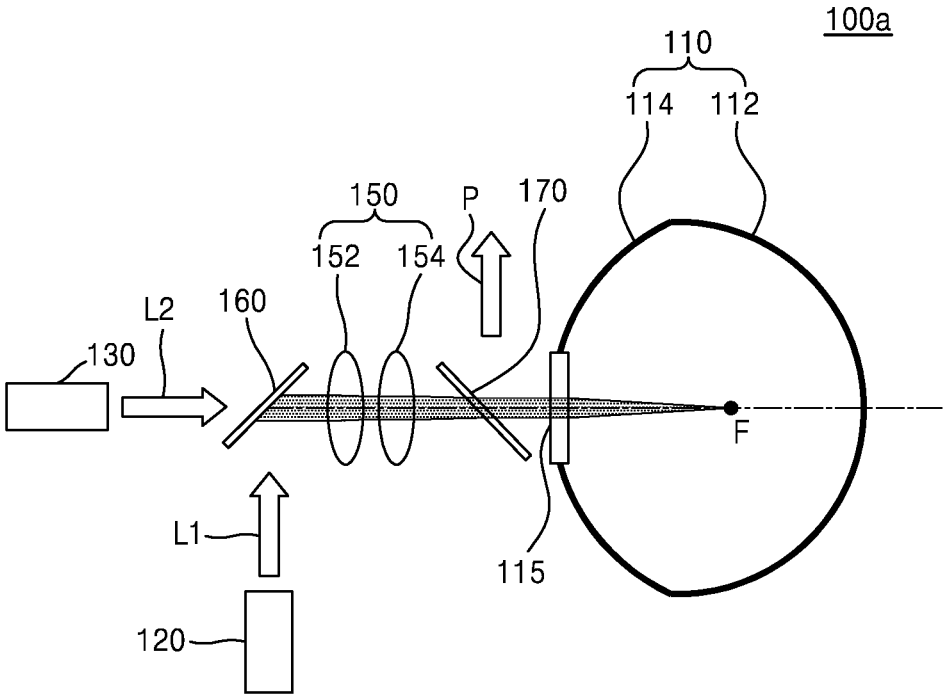
FIG. 3 is a view illustrating a plasma light source apparatus according to an exemplary embodiment of the present invention.

FIG. 3 is a view of a plasma light source apparatus 100*a* according to an exemplary embodiment of the present invention. FIG. 3 is used below for explaining a process of providing a laser beam.

Referring to FIG. 3, the plasma light source apparatus 100*a* according to an exemplary embodiment of the present invention may be different from the plasma light source apparatus 100 of FIG. 1 in a structure of a second lens array 150. For example, in the plasma light source apparatus 100*a*, the second lens array 150 may include a collimating lens 152 and a focusing lens 154.

The collimating lens 152 may convert each the first laser beam L1 and the second laser beam L2 into collimated light. The collimating lens 152 may include two or more lenses. The focusing lens 154 may focus incident light on a given focal point. The focusing lens 154 may be, for example, a convex lens, and the focal point may be changed by changing a curvature of the convex lens. For example, a focal point of the focusing lens 154 may be the same as the focal point F of the elliptical mirror 112.

In the plasma light source apparatus 100*a* of the present embodiment, the first laser beam L1 and the second laser beam L2 may be directly collected on the focal point F of the elliptical mirror 112 by using the first lens array 150. In detail, the first laser beam L1 that is provided to the chamber 11 by being reflected by the first dichroic mirror 160 and by being transmitted through the second dichroic mirror 170 may be collected on the focal point F of the elliptical mirror 112 by the first lens array 150, to ignite plasma. The second laser beam L2 that is provided by being transmitted through both the first dichroic mirror 160 and the second dichroic mirror 170 may be collected on the focal point F of the elliptical mirror by the first lens array 150, to maintain the plasma and increase an intensity of the plasma.

A process of outputting plasma light in the plasma light source apparatus 100*a* according to an exemplary embodiment of the present invention may be the same as the process described above with reference to FIGS. 2A and 2B.

FIGS. 4 through 6B are views of plasma light source apparatuses according to exemplary embodiments of the present invention. These views are referred to below for explaining a process of providing a laser beam.

Figure 4:
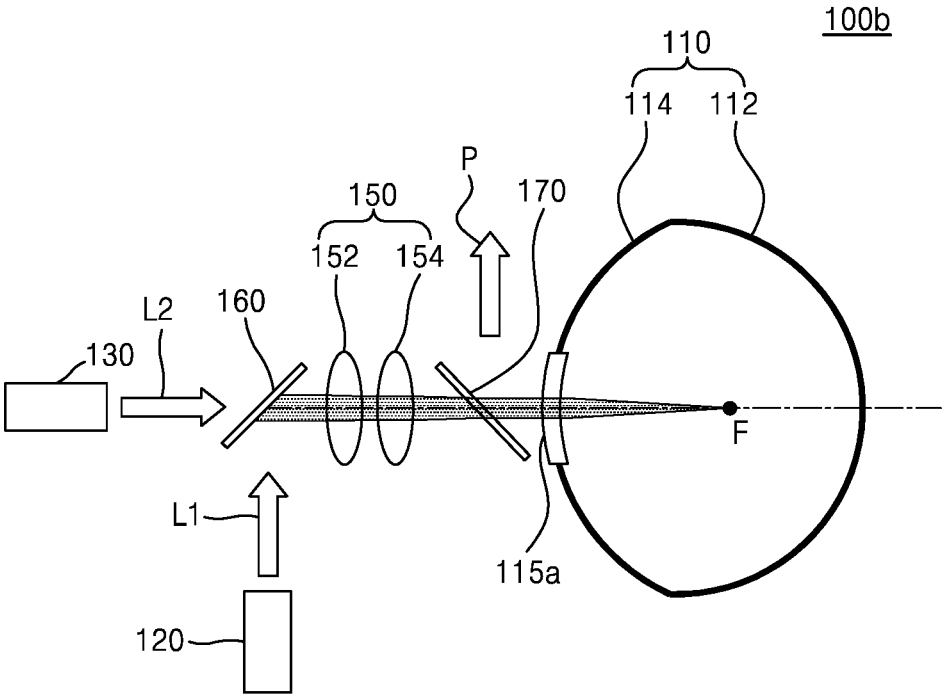
FIGS. 4 through 6B are views illustrating plasma light source apparatuses according to exemplary embodiments of the present invention.

Referring to FIG. 4, a plasma light source apparatus 100*b* according to an exemplary embodiment of the present invention may be different from the plasma light source apparatus 100 described above with reference to FIG. 1, particularly, with respect to a structure of a window 115*a*. In the plasma light source apparatus 100*b*, the window 115*a* may have a curved shape rather than being flat. For example, the window 115*a* may be formed to have the same curvature as that of the spherical mirror 114.

Since the window 115*a* is not a mirror for reflecting light but is rather a path through which light is transmitted, even though the window 115*a* has a curvature, the path of the light transmitted therethrough is not greatly affected. Accordingly, the window 115*a* having a curved form might not greatly affect the path and shape of the first laser beam L1 and the second laser beam L2 that are provided to the chamber 110. Similarly, the path and shape of the plasma light P that is output might not be greatly affected.

Figure 5A:
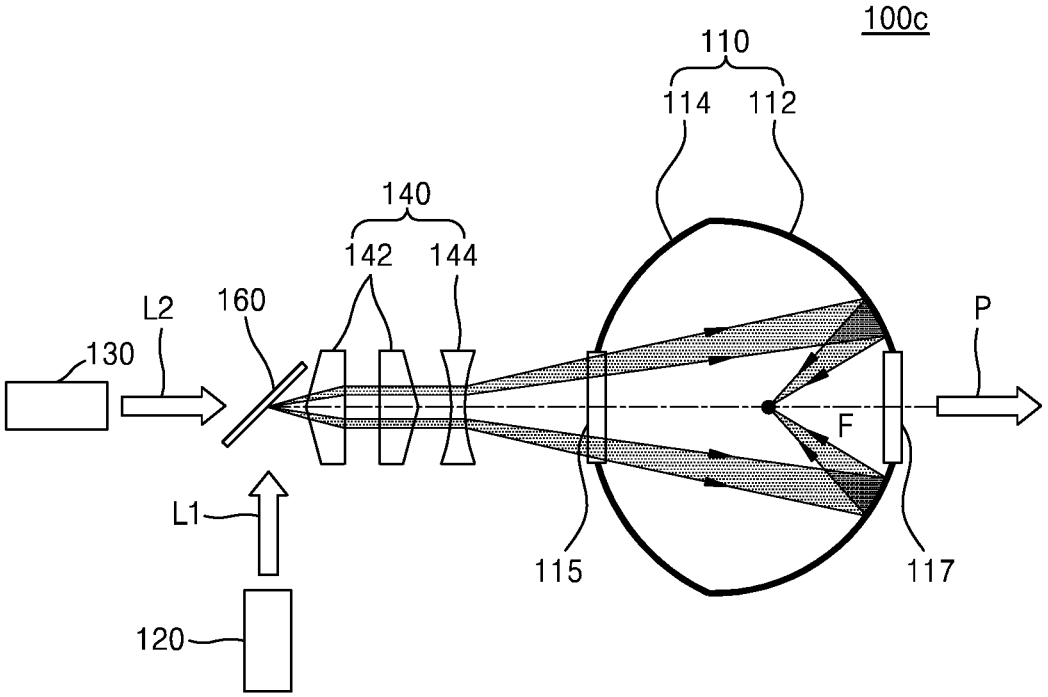
Figure 5B:
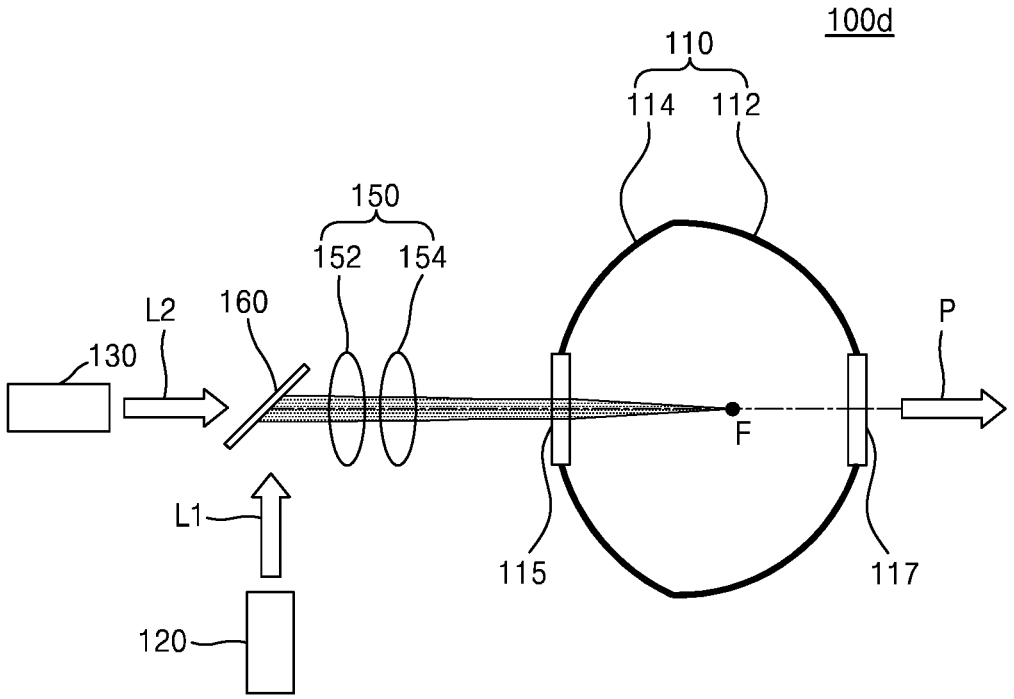

Referring to FIGS. 5A and 5B, in plasma light sources 100*c* and 100*d* according to exemplary embodiments of the present invention, the plasma light P may be output from the back of the elliptical mirror 112. Accordingly, a window 117 through which the plasma light P may be output may be disposed on the elliptical mirror 112.

The first laser beam L1 and the second laser beam L2 may be provided to the front of the chamber 110 through the window 115 of the spherical mirror 114, as was described above with respect to the plasma light source apparatus 100 of FIG. 1. Since the window 115 through which the first laser beam L1 and the second laser beam L2 enter the chamber and the window 117 through which the plasma light P is output are located at different positions, a second dichroic mirror may be omitted. If necessary, although a mirror may be disposed behind the window 117 in order to change a travel direction of the plasma light P, this mirror does not need to be a dichroic mirror.

The plasma light source apparatus 100*c* of FIG. 5A may correspond to the plasma light source apparatus 100 of FIG. 1. Accordingly, the plasma light source apparatus 100*c* of FIG. 5A may include the first lens array 140 and may provide the first laser beam L1 and the second laser beam L2, which may have ring shapes, to the chamber 110. Since the window 117 is disposed on the elliptical mirror 112, unlike in the plasma light source apparatus 100 of FIG. 1, the first laser beam L1 and the second laser beam L2 may be incident on and reflected by portions of the elliptical mirror 112 outside the window 117 and may be collected on the focal point F.

The plasma light source apparatus 100*d* of FIG. 5B may have features in common with the plasma light source apparatus 100*a* of FIG. 3. Accordingly, the plasma light source apparatus 100*d* of FIG. 5B may include the second lens array 150, and may collect the first laser beam L1 and the second laser beam L2 on the focal point F of the elliptical mirror 112.

A process performed by the plasma light source apparatuses 100*c* and 100*d* of FIGS. 5A and 5B to output the plasma light P may be based on the law of reflection of the elliptical mirror and the spherical mirror described with reference to FIGS. 2A and 2B. However, the plasma light P may be output back through the window 117 of the elliptical mirror 112.

When the window 115 of the spherical mirror 114 is very small, the window does not tend to affect the light that is transmitted therethrough. However, when the window 115 is relatively large, the window 115 may affect a process of collecting the plasma light P in the chamber 110. For example, since plasma light traveling to the window 115 is transmitted through the window 115 and is the discharged, the plasma light might not be collected. Accordingly, the window 115 may be a dichroic mirror in order to increase efficiency of collecting plasma light. For example, the window 115 may be a dichroic mirror that transmits the first laser beam L1 and the second laser beam L2 and reflects the plasma light P. Also, the window 115 may have the same curvature as that of the spherical mirror 114 in order to maintain characteristics of the spherical mirror 114. In addition, efficiency of collecting plasma light may be increased by locating an additional dichroic mirror behind the window 115 and reflecting plasma light by using the dichoric mirror, instead of forming a dichroic mirror as the window 115.

Figure 6A:
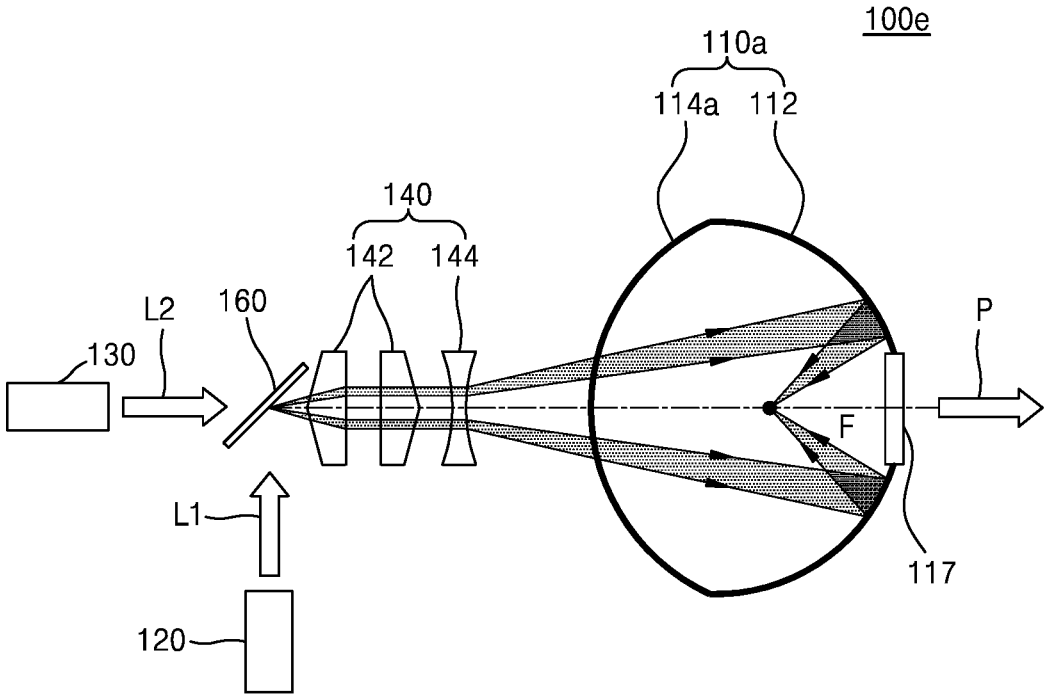
Figure 6B:
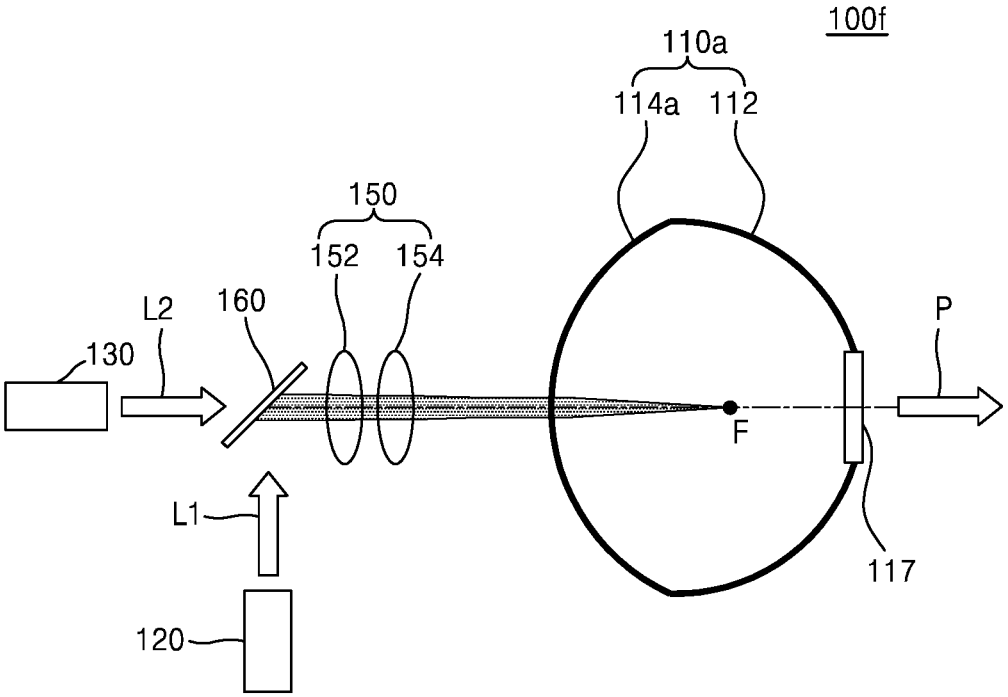

Referring to FIGS. 6A and 6B, plasma light source apparatuses 100*e* and 100*f* according to exemplary embodiments of the present invention may be similar to the plasma light source apparatuses 100*c* and 100*d* described above with respect to FIGS. 5A and 5B in that the plasma light P is output from the back of the elliptical mirror 112. However, the plasma light source apparatuses 100*e* and 100*f* might not include an additional window on a spherical mirror 114*a*. For example, in the plasma light source apparatuses 100*e* and 100*f*, the spherical mirror 114*a* may be a dichroic mirror. For example, the spherical mirror 114*a* may be a dichroic mirror that transmits the first laser beam L1 and the second laser beam L2 and reflects the plasma light P.

As shown in FIGS. 6A and 6B, the plasma light source apparatus 100*e* of FIG. 6A may have features on common with the plasma light source apparatus 100*c* of FIG. 5A. Accordingly, the plasma light source apparatus 100*e* of FIG. 6A may include the first lens array 140 and may provide the first laser beam L1 and the second laser beam L2, as beams having ring shapes, to a chamber 110*a*. Also, the plasma light source apparatus 100*f* of FIG. 6B may have features in common with the plasma light source apparatus 100*d* of FIG. 5B, and may include the second lens array 150 and may collect the first laser beam L1 and the second laser beam L2 on the focal point F of the elliptical mirror 112.

A process performed by the plasma light source apparatuses 100*e* and 100*f* of FIGS. 6A and 6B to output the plasma light P may be based on the law of reflection of the elliptical mirror and the spherical mirror described with reference to FIGS. 2A and 2B. However, the plasma light P may be output back through the window 117 of the elliptical mirror 112.

In each plasma light source apparatus of FIGS. 5A through 6B, the first laser beam L1 and the second laser beam L2 enter the chamber through the front of the spherical mirror 114 or 114*a* and the plasma light P is output from the back of the elliptical mirror 112. However, the instant invention is not limited to a particular structure for the plasma light source apparatus. For example, a plasma light source apparatus in which the first laser beam L1 and the second laser beam L2 are provided to the back of the elliptical mirror 112 and the plasma light P is output from the front of the spherical mirror 114 may be provided by appropriately adjusting transmission and reflection characteristics of the spherical mirror 114 and the elliptical mirror 112 and appropriately locating the window. Also, a plasma light source apparatus in which the first laser beam L1 and the second laser beam L2 are provided to the back of the elliptical mirror 112 and the plasma light P is also output from the back of the elliptical mirror 112 may be provided.

Figure 7A:
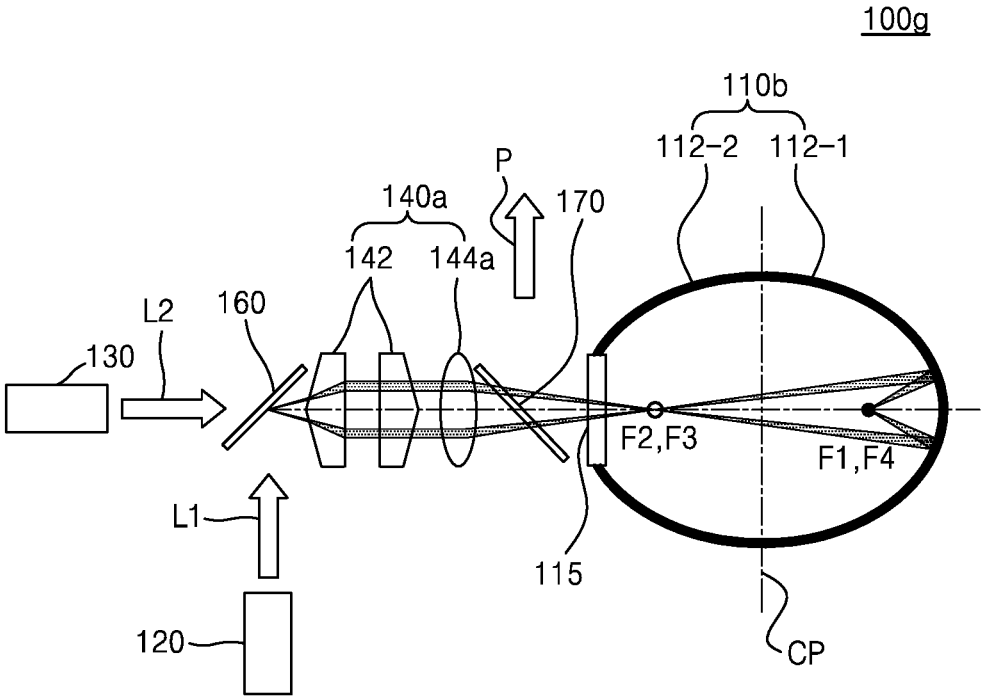
FIGS. 7A and 7B are views illustrating plasma light source apparatuses according to exemplary embodiments of the present invention.
Figure 7B:
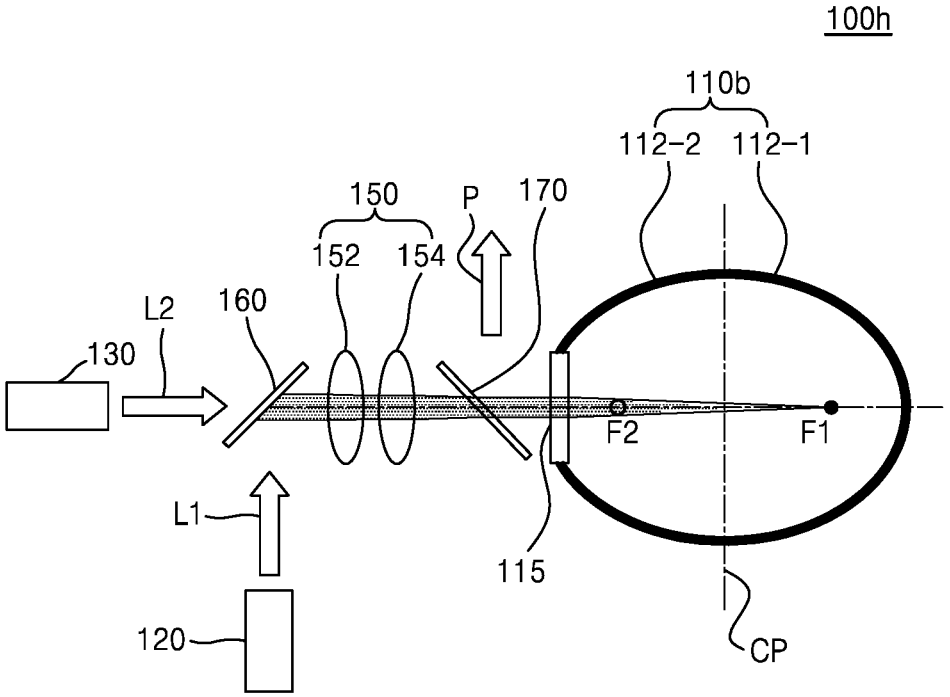

FIGS. 7A and 7B are views of plasma light source apparatuses according to exemplary embodiments of the present invention. These figures will be referred to below in explaining a process of providing a laser beam.

Referring to FIG. 7A, a plasma light source apparatus 100*g* may include a chamber 110*b* in which two elliptical mirrors, for example, first and second elliptical mirrors 112-1 and 112-2, are coupled to each other. For example, in the plasma light source apparatus 100*g* according to exemplary embodiments of the present invention, the chamber 110*b* may include the first elliptical mirror 112-1 and the second elliptical mirror 112-2. Also, the first elliptical mirror 112-1 and the second elliptical mirror 112-2 may constitute a 3D ellipsoidal object by being coupled to each other about a central face CP. For example, the combined shape of the first and second elliptical mirrors 112-1 and 112-1 may form, what would be a 3D ellipsoidal object (but for the presence of the window 115).

The first elliptical mirror 112-1 has two focal points. From among the two focal points, a focal point closer to the first elliptical mirror 112-1 is referred to as a first focal point F1 and a focal point farther from the first elliptical mirror 112-1 is referred to as a second focal point F2. Also, the second elliptical mirror 112-2 has two focal points. From among the two focal points, a focal point closer to the second elliptical mirror 112-2 is referred to as a third focal point F3 and a focal point farther from the second elliptical mirror 112-2 is referred to as a fourth focal point F4. As shown in FIG. 7A, positions of the first focal point F1 and the fourth focal point F4 may be the same and positions of the second focal point F2 and the third focal point F3 may be the same. This is because the first elliptical mirror 112-1 and the second elliptical mirror 112-2 together constitute the 3D ellipsoidal object, for example as described above. Accordingly, the chamber 110*b* may be described as one 3D elliptical mirror, instead of as a structure in which the two elliptical mirrors 112-1 and 112-2 are coupled to each other.

In the plasma light source apparatus 100*g* of FIG. 7A, a structure of a first lens array 140*a* may be different from a structure of the first lens array 140 of the plasma light source apparatus 100 of FIG. 1. For example, the first lens array 140*a* may include a focusing lens 144*a*, instead of a concave lens. Accordingly, the first laser beam L1 and the second laser beam L2 may be collected on the second focal point F2 of the first elliptical mirror 112-1, may travel back to the first elliptical mirror 112-1, and may be collected on the first focal point F1. Plasma ignition and maintenance by the first laser beam L1 and the second laser beam L2 may be performed on at least one of the first focal point F1 and the second focal point F2.

Referring to FIG. 7B, a plasma light source apparatus 100*h* according to an exemplary embodiment of the present invention may be similar to the plasma light source apparatus 100*g* of FIG. 7A in that the plasma light source apparatus 100*h* includes the chamber 110*b* in which two elliptical mirrors, for example, the first and second elliptical mirrors 112-1 and 112-2, are coupled to each other. However, since the plasma light source apparatus 100*h* includes the second lens array 150, the first laser beam L1 and the second laser beam L2 may be collected on the first focal point F1 of the first elliptical mirror 112-1. Also, the first laser beam L1 and the second laser beam L2 may be collected on the second focal point F2 of the first elliptical mirror 112-1 by adjusting the focusing lens 154.

Although not shown in FIGS. 7A and 7B, a plasma light source apparatus in which the plasma light P is output from the back of the first elliptical mirror 112-1 as shown in FIGS. 5A and 5B may be provided. Also, when a plasma light source apparatus in which the plasma light P is output from the back of the first elliptical mirror 112-1, as shown in FIGS. 6A and 6B, is provided, the second elliptical mirror 112-2 may be a dichroic mirror. Furthermore, a direction in which the first laser beam L1 and the second laser beam L2 enter the chamber along and a direction in which the plasma light P is output may be changed in various ways by appropriately adjusting reflection and transmission characteristics of the first elliptical mirror 112-1 and the second elliptical mirror 1132-2 and appropriately locating the window 115.

Figure 8A:
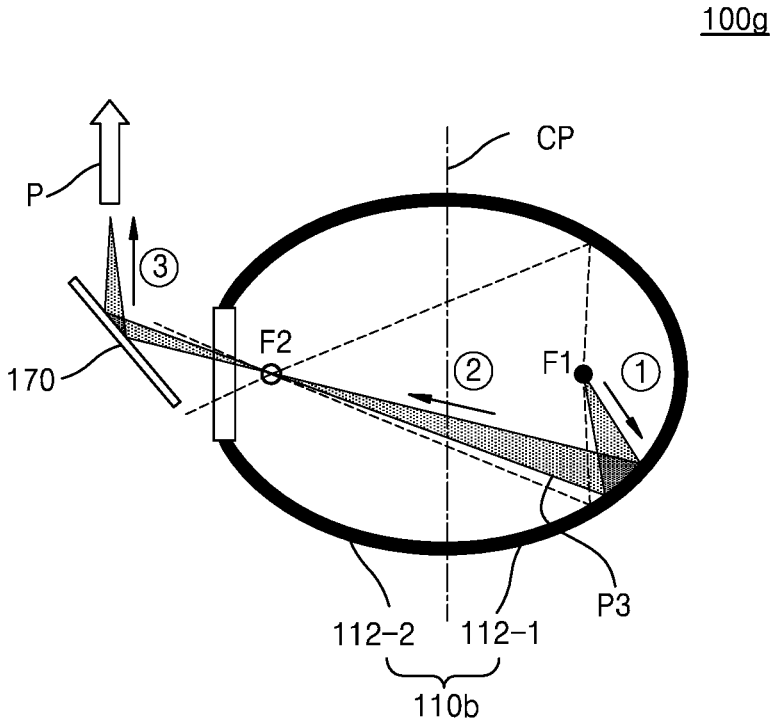
FIGS. 8A and 8B are views illustrating a process performed by the plasma light source apparatus of FIG. 7A to output plasma light according to exemplary embodiments of the present invention.
Figure 8B:
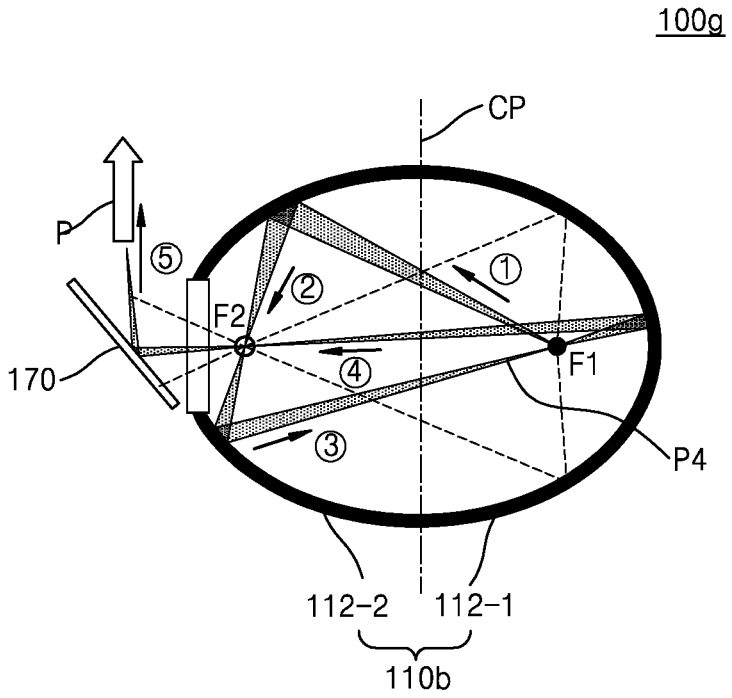

FIGS. 8A and 8B are views illustrating a process performed by the plasma light source apparatus 100*g* of FIG. 7A to output plasma light.

Referring to FIGS. 8A and 8B, in the plasma light source apparatus 100*g* of FIG. 7A, plasma may be generated on the first focal point F1 and/or the second focal point F2 of the first elliptical mirror 112-1 by the first laser beam L1 and may be maintained by the second laser beam L2 as described above. As shown in FIG. 8A, it is assumed that plasma is generated on the first focal point F1 of the first elliptical mirror 112-1 and plasma light P3 emitted by the plasma travels to the first elliptical mirror 112-1. In this case, the plasma light P3 may be reflected by the first elliptical mirror 112-1, may then pass through the second focal point F2 and the window 115, and then may be discharged from the chamber 110*b* ((1)→(2)→(3)). The plasma light P3 discharged from the chamber 110*b* may be reflected (3) by the second dichroic mirror 170 to the homogenizer.

As shown in FIG. 8B, it is assumed that plasma is generated on the first focal point F of the first elliptical mirror 112-1 and plasma light P4 emitted by the plasma travels to the second elliptical mirror 112-2. In this case, due to the law of reflection of the elliptical mirror, the plasma light P4 is reflected by the second elliptical mirror 112-2 to the second focal point F2, for example, the third focal point F3 of the second elliptical mirror 112-2 ((1)→(2)), and then is reflected (3) by the second elliptical mirror 112-2 to the fourth focal point F4 of the second elliptical mirror 112-2, for example, the first focal point F1 of the first elliptical mirror 112-1. Next, the plasma light P4 may be reflected by the first elliptical mirror 112-1, may then pass through the second focal point F2 and the window 115, and may then be discharged (4) from the chamber 110*b*. The plasma light P4 discharged from the chamber 110*b* may be reflected by the second dichroic mirror 170 to the homogenizer.

In the plasma light source apparatuses 100*g* and 100*h*, since the chamber 110*b* includes the first and second elliptical mirrors 112-1 and 112-2 that are coupled to each other, such that they face each other, and collects and outputs both parts of the plasma light travelling backward and frontward, efficiency of outputting the plasma light P may be maximized.

Some of the effects and features of the plasma light source apparatuses may be summarized as follows. First, since a structure for sealing a high-pressure gas includes a lamp, a chamber, and a reflecting mirror all integrated together, a compact light source apparatus may be provided. Second, since an inner surface of a chamber includes two curved mirrors, plasma light emitted from plasma that is generated in the chamber may be efficiently collected and output, thereby simplifying an optical system. Third, since an additional lamp such as a bulb-type lamp is not provided in the chamber, the light source apparatus may be non-removable and costs associated with manufacturing may be reduced. Fourth, since a high-pressure gas may be sealed and the risk of damage is much lower than that when a typical bulb-type lamp formed of glass or quartz is used, the light source apparatus may be non-removable and costs associated with manufacturing may be reduced.

Figure 9:
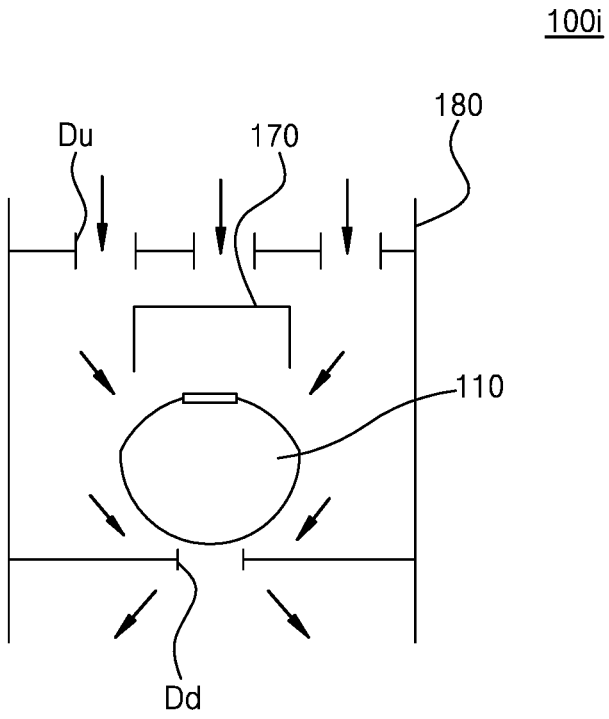
FIGS. 9 through 11 are views illustrating plasma light source apparatuses according to exemplary embodiments of the present invention.
Figure 10:
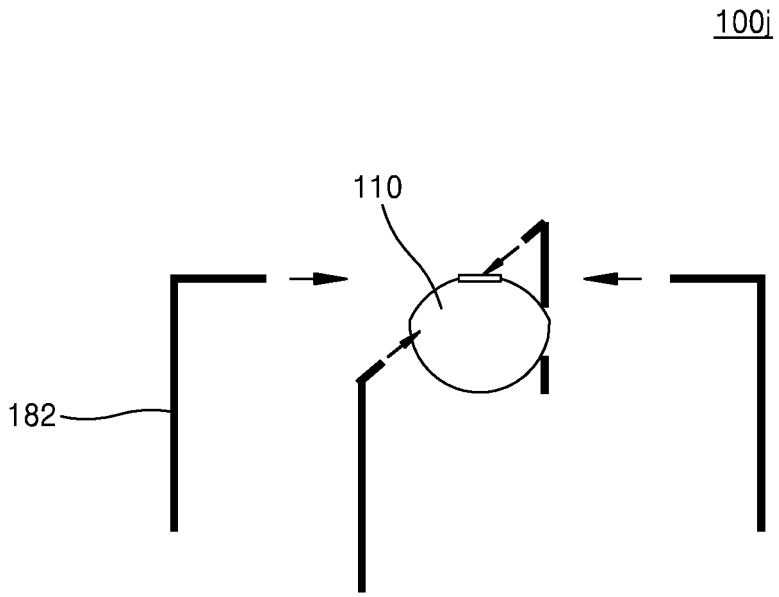
Figure 11:
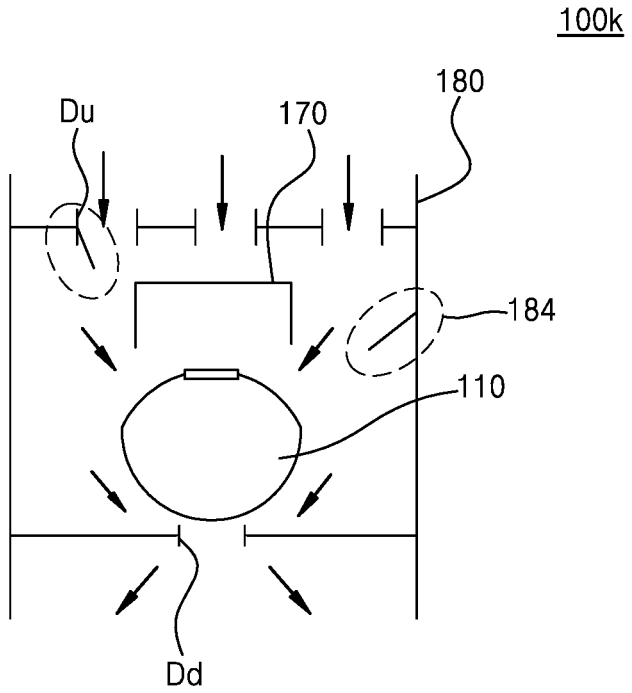

FIGS. 9 through 11 are views of plasma light source apparatuses according to exemplary embodiments of the present invention.

Referring to FIG. 9, a plasma light source apparatus 100*i* according to an exemplary embodiment of the present invention may further include a cooling device 180. The cooling device 180 may be disposed to surround the chamber 110 and the second dichroic mirror 170. Where desired, the second dichroic mirror 170 may be disposed outside of the cooling device 180.

In the plasma light source apparatus 100*i*, a cooling gas flows downwardly from the top of the figure to the bottom of the figure, as marked by arrows in the cooling device 180, thereby maximizing efficiency of cooling the chamber 110. The cooling gas may be clean dry air (CDA), general air, or nitrogen gas. However, a type and a temperature of the cooling gas are not limited to any particular configuration.

For example, in an existing plasma light source apparatus, when a maximum temperature of a lamp exceeds a lamp rupture temperature, the power of a laser may not be increased and thus it may be difficult to increase an output of plasma light emitted by plasma, for example, UV light. In some plasma light source apparatuses, when plasma is generated in a lamp, a temperature of an upper portion of the lamp is relatively high due to convection. When cooling is performed, and an air current speed is increased in order to cool the lamp, the temperature of the lamp may be reduced unevenly and a difference between the temperature of the upper portion and the temperature of the lower portion of the lamp develops, thereby increasing stress applied to the lamp. Also, the air current and heat that are generated as a result of cooling the lamp may degrade the performance of the device that incorporates the lamp. For example, the air current and the heat in the lamp housing may cause an inspection stage to be shaken, thereby degrading the performance of an inspector device that utilizes the lamp.

In contrast, in the plasma light source apparatus 100*i* according to exemplary embodiments of the present invention, since an air current of a cooling gas flows from the top down, as an air current speed in the cooling device 180 increases, a surface temperature of the chamber 110 decreases, thereby increasing cooling efficiency. Also, since the direction of the air current of the cooling gas is opposite to the direction of gravity, a temperature difference between an upper portion and a lower portion of the chamber 110 may be reduced, thereby reducing heat stress applied to the chamber 110. For example, regarding a structure of the cooling device 180, a cooling gas may be injected only through an upper door "Du" of the cooling device 180 from a constant-temperature bath in order not to change an air current and a temperature in portions other than the upper door Du of the cooling device 180. An exhaust device may be utilized to smoothly discharge the cooling gas through a lower door "Dd". Furthermore, since side doors may be hermetically closed and a heat shielding material may be inserted to prevent heat from escaping, the air current or heat in the cooling device 180 might not affect the outer environment, such as the device that the plasma light source apparatus 100*i* is incorporated into.

Referring to FIG. 10, in a plasma light source apparatus 100*j* according to an exemplary embodiment of the present invention, air guns 182 may be provided in the cooling device 180. The air guns 182 are devices for forcibly injecting a cooling gas into a specific portion of the plasma light source apparatus 100*j*. In the plasma light source apparatus 100*j*, four air guns 184 may be provided and may forcibly eject a cooling gas to an upper portion of the chamber 110. However, the number of the air guns 182 is not limited to 4. In FIG. 10, the cooling device 180 is not shown in order to clearly show structures of the air guns 182.

Cooling gases ejected from the air guns 182 may cool the upper portion of the chamber 110 and then, the cooling gasses may be discharged through a lower door and/or an upper door. In the plasma light source apparatus 100*j*, since the air guns 182 are disposed in the cooling device 180, cooling efficiency may be further increased.

Referring to FIG. 11, in a plasma light source apparatus 100*k* according to an exemplary embodiment of the present invention, air guides 184 may be provided in the cooling device 180. For example, air guides 184 may be embodied as walls, baffles, or tubes. The air guides 184 may guide the flow of a cooling gas to a specific portion of the plasma light source apparatus 100*k*. For example, the air guides 184 may guide a cooling gas injected through the upper door Du to pass through an upper portion of the chamber 110. In the plasma light source apparatus 100*k*, although two air guides 184 are shown close to a side surface and the upper door Du of the cooling device 180, the number and positions of the air guides 184 are not limited thereto. For example, an appropriate number of the air guides 184 may be located at appropriate positions so that a cooling gas flows to a desired portion of the plasma light source apparatus 100*k*. In the plasma light source apparatus 100*k*, since the air guides 184 are disposed in the cooling device 180, cooling efficiency may be further increased.

Although not shown, both an air gun and an air guide may be provided in the cooling device 180. When both the air gun and the air guide are provided, cooling efficiency of the cooling device 180 may be further increased.

Table 1 shows cooling efficiency of existing comparative plasma light source apparatus employing a cooling device using a bottom-up method, in which air moves upwardly from the bottom, and cooling efficiency of a plasma light source apparatus according to an exemplary embodiment of the present invention employing a cooling device using a top-down method, in which air moves downwardly from the top. The plasma light source apparatus according to an exemplary embodiment of the present invention is subdivided according to whether an air gun or/and an air guide are provided.

TABLE 1

| | A | B | C | D | E | F |
|---|---|---|---|---|---|---|
| Air current direction | Bottom-Up | Bottom-Up | Top-Down | Top-Down | Top-Down | Top-Down |
| Air gun | yes | no | yes | no | yes | no |
| Air guide | — | — | no | no | yes | yes |
| Maximum temperature (° C.) | 604.5 | 659.6 | 534.2 | 538.7 | 436.5 | 427.0 |
| Average temperature (° C.) | 399.2 | 407.7 | 389.7 | 382.3 | 301.8 | 302.8 |
| Temperature difference between upper/lower | 320.8 | 369.3 | 157.5 | 159.2 | 152.7 | 171.3 |

In Table 1, A and B may correspond to the comparative plasma light source apparatus and C through F may correspond to plasma light source apparatus according to exemplary embodiments of the present invention. As may be seen from Table 1, the plasma light source apparatus E in which a cooling device is designed to use a top-down method and both an air gun and an air guide are provided in the cooling device has highest cooling efficiency. For example, the plasma light source apparatus E may have a lowest average temperature and a smallest temperature difference between upper and lower ends.

Figure 12:
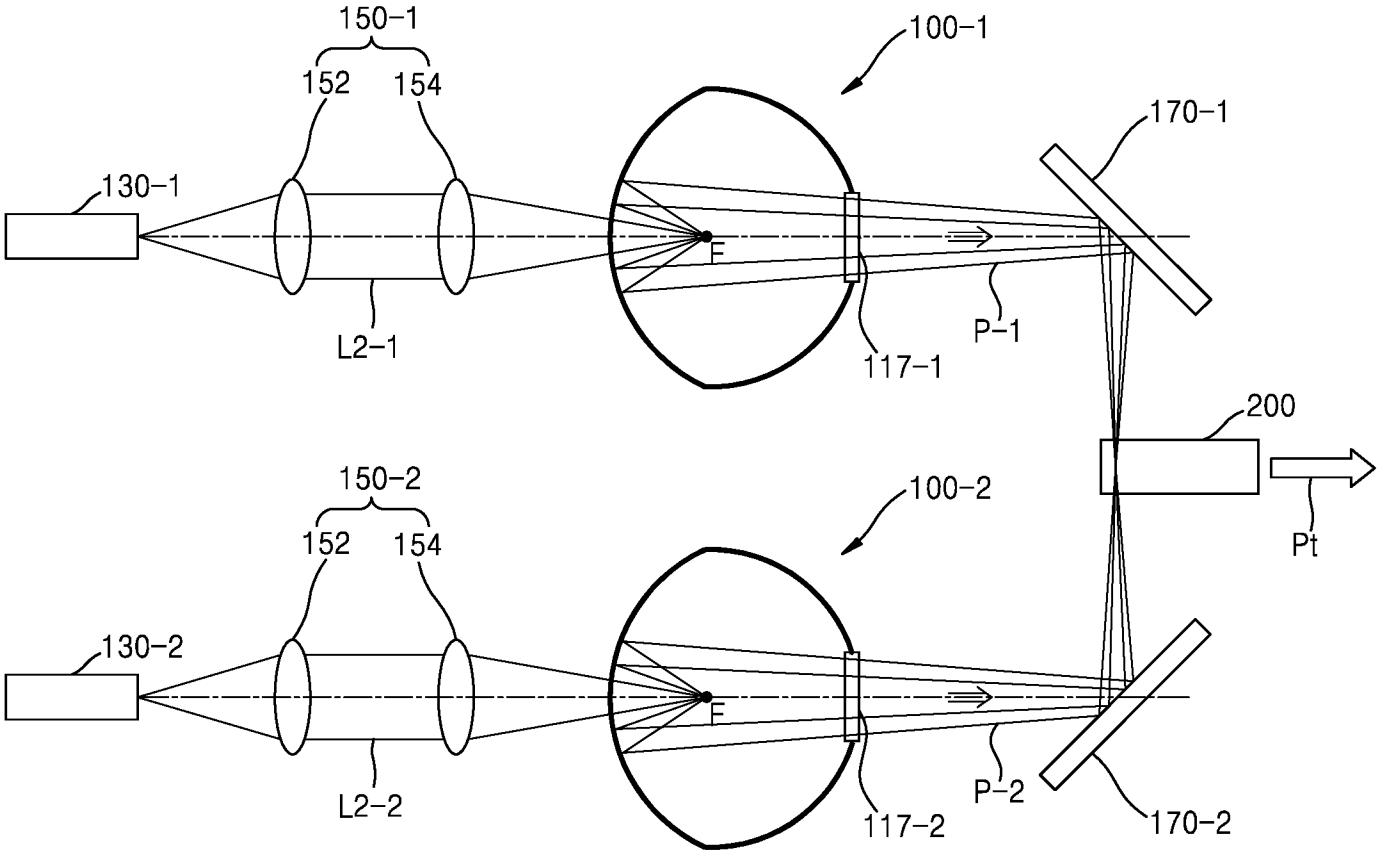
FIG. 12 is a view illustrating a light source system including a plasma light source apparatus according to an exemplary embodiment of the present invention.

FIG. 12 is a view of a light source system 1000 including a plasma light source apparatus according to an exemplary embodiment of the present invention.

Referring to FIG. 12, the light source system 1000 may include two plasma light source apparatuses and a light-combining optical device 200. The two plasma light source apparatuses may include a first plasma light source apparatus 100-1 and a second plasma light source apparatus 100-2. Each of the first plasma light source apparatus 100-1 and the second plasma light source apparatus 100-2 may be any one of the plasma light source apparatuses 100 and 100*a* through 100*k* of FIGS. 1 through 11, or a variation thereof.

The first plasma light source apparatus 100-1 and the second plasma light source apparatus 100-2 may have the same structure as shown in FIG. 12. However, exemplary embodiments of the present invention are not limited thereto. For example, the first plasma light source apparatus 100-1 and the second plasma light source 100-2 may have different structures. The first plasma light source apparatus 100-1 and the second plasma light source apparatus 100-2 may output plasma light having the same wavelength or may output plasma light having different wavelengths.

In FIG. 12, each of the first plasma light source apparatus 100-1 and the second plasma light source apparatus 1002 may have, for example, the same structure as that of the plasma light source apparatus 100*f* of FIG. 6B. Accordingly, in each of the first plasma light source apparatus 100-1 and the second plasma light source apparatus 100-2, the first laser beam L1 and the second laser beam L2 may enter the chamber through the window 115 from the front of a spherical mirror and the plasma light P may exit the chamber to the back of an elliptical mirror. Also, the first laser beam L1 and the second laser beam L2 enter the chamber through a spherical mirror that is a dichroic mirror, and the plasma light P may exit the chamber through the window 117 of an elliptical mirror. In each of the first plasma light source apparatus 100-1 and the second plasma light source apparatus 100-2, a first laser generator and a first dichroic mirror are not shown.

Plasma light P-1 of the first plasma light source apparatus 100-1 may be reflected by a second dichroic mirror 170-1 to the light-combining optical device 220, and plasma light P-2 of the second plasma light source apparatus 100-2 may be reflected by a second dichroic mirror 170-2 to the light-combining optical device 200. When the plasma light source apparatus 100*f* of FIG. 6B is used as each of the first plasma light source apparatus 100-1 and the second plasma light source apparatus 100-2, general mirrors (e.g. mirrors that are not dichroic), instead of the second dichroic mirrors 170-1 and 170-2, may be used.

The light-combining optical device 200 may be an optical device for combining the plasma lights P-1 and P-2 respectively output from the first and second plasma light source apparatuses 100-1 and 100-2. The light-combining device 200 may output one combined plasma light Pt. The light-combining optical device 200 may be at least one of, for example, a rod lens having an inclined surface, a dichroic mirror, and a beam splitter. However, the light-combining optical device 200 is not limited thereto. For example, any optical device for combining light may be used as the light-combining optical device 200.

The light source system 1000 according to exemplary embodiments of the present invention may include three or more plasma light source apparatuses. In this case, the light-combining optical device 200 may combine plasma light from three or more independent sources. Also, the light-combining optical device 200 may not only combine plasma light having the same wavelength but may also combine plasma light having different wavelengths. A structure of the light-combining optical device 200 and a process performed by the light-combining optical device 200 to combine plasma light from at least two independent sources will be explained below in detail with reference to FIGS. 13A through 15.

Since the light source system may combine plasma light output from two or more plasma light source apparatuses by using the light-combining optical device 200 and may collect and output one combined plasma light to a target optical system such as a rod lens or a homogenizer, plasma light having high power and high brightness may be provided.

Figure 13A:
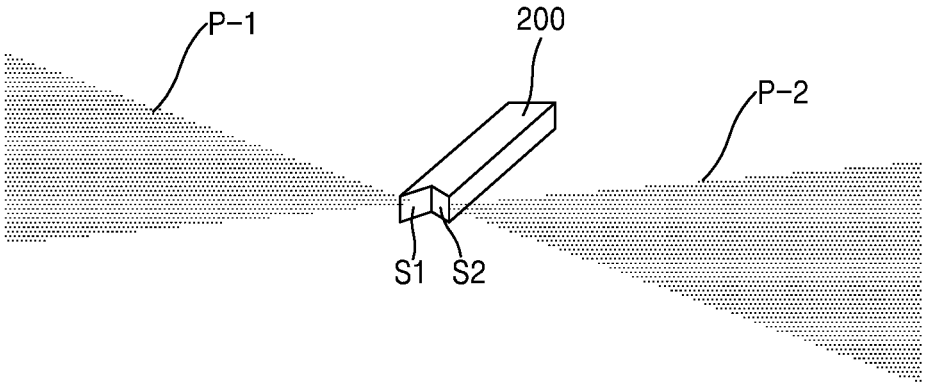
FIGS. 13A and 13B are conceptual views illustrating a process of combining plasma light from two sources in accordance with exemplary embodiments of the present invention.
Figure 13B:
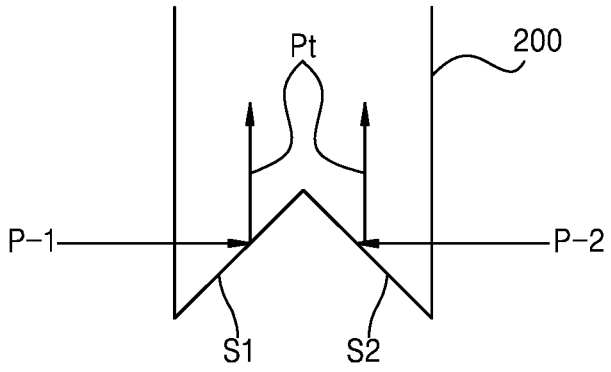

FIGS. 13A and 13B are conceptual views illustrating a process of plasma light from two independent sources in accordance with exemplary embodiments of the present invention. FIG. 13A is a perspective view of the light-combining optical device 200 that is a rod lens. FIG. 13B is a plan view of the light-combining optical device 200 illustrated in FIG. 13A.

Referring to FIGS. 13A and 13B, the light-combining optical device 200 may be a rod lens including two inclined surfaces S1 and S2. The rod lens may have, for example, a quadrangular pillar shape that is longer in a first direction than in a second direction that is perpendicular to the first direction. First and second plasma lights P-1 and P-2, may be incident on the two inclined surfaces S1 and S2, respectively, and may be combined with each other. For example, the first plasma light P-1 may be incident on the first inclined surface S1, may be reflected by the first inclined surface S1, and may travel in the first direction. The second plasma light P-2 may be incident on the second inclined surface S2, may be reflected by the second inclined surface S2, and may travel in the first direction. Accordingly, the first plasma light P-1 and the second plasma light P-2 may be combined with each other into one combined plasma light Pt. Also, an intensity of the combined plasma light Pt may be high enough to correspond to a sum of the intensity of the first plasma light P-1 and the intensity of the second plasma light P-2.

Figure 14A:
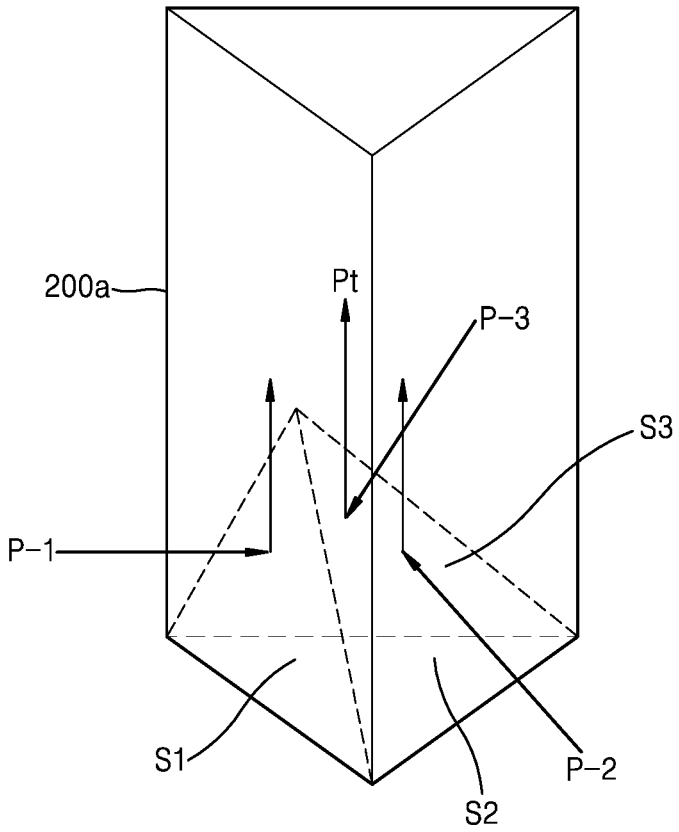
FIGS. 14A and 14B are conceptual views illustrating a process of combining plasma light from three sources in accordance with exemplary embodiments of the present invention.
Figure 14B:
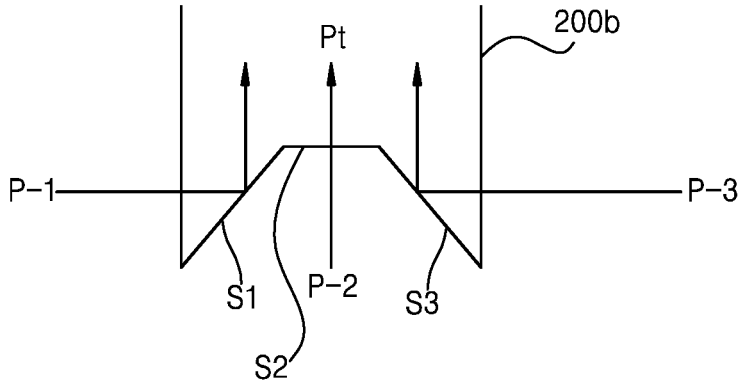

FIGS. 14A and 14B are conceptual views illustrating a process of combining plasma light from three independent sources.

Referring to FIG. 14A, a light-combining optical device 200*a* may be a rod lens including three inclined surfaces, for example, first through third inclined surfaces S1, S2, and S3. The rod lens may have a triangular prism shape that is longer in a first direction than a second direction that is perpendicular to the first direction. The first through third inclined surfaces S1, S2, and S3 may be, for example, three side surfaces of the triangular pyramid shape, and plasma light may be incident on the first through third inclined surfaces S1, S2, and S3 and may thereafter be combined with one another. For example, first plasma light P-1 may be incident on the first inclined surface S1, may be reflected by the first inclined surface S1, and may travel in the first direction. Second plasma light P-2 may be incident on the second inclined surface S2, may be reflected by the second inclined surface S2, and may travel in the first direction. Third plasma light P-3 may be incident on the third inclined surface S3, may be reflected by the third inclined surface S3, and may travel in the first direction. The first plasma light P-1, the second plasma light P-2, and the third plasma light P-3 may be combined with one another to form one combined plasma light Pt.

Referring to FIG. 14B, a light-combining optical device 200*b* may be a rod lens including two inclined surfaces, for example, first and second inclined surfaces S1 and S3, and one horizontal surface S2. The rod lens may have a quadrangular pillar shape that is longest in a first direction, like the light-combining optical device 200 of FIG. 12A. Plasma light from three independent sources, for example, first through third plasma lights P-1, P-2, and P-3, may be incident on the first and second inclined surfaces S1 and S3 and the horizontal surface S2 and may be thereafter combined with one another. For example, the first plasma light P-1 may be incident on the first inclined surface S1, may be reflected by the first inclined surface S1, and may travel in the first direction. The second plasma light P-2 may be incident on the horizontal surface S2 and may travel in the first direction. The third plasma light P-3 may be incident on the second inclined surface S3, may be reflected by the second inclined surface S3, and may travel in the first direction. The first plasma light P-1, the second plasma light P-2, and the third plasma light P-3 may be combined with one another into one combined plasma light Pt.

Although, as described above, a rod lens is used as a light-combining optical device for combining plasma light from two or three independent sources, the light-combining optical device is not limited thereto. For example, the light-combining optical device may combine plasma light from four or more independent sources by modifying a structure of a rod lens. Also, the light-combining optical device may combine plasma light by using two or more rod lenses, instead of one rod lens. Also, the light-combining optical device may combine plasma light by using an optical device other than a rod lens.

Figure 15:
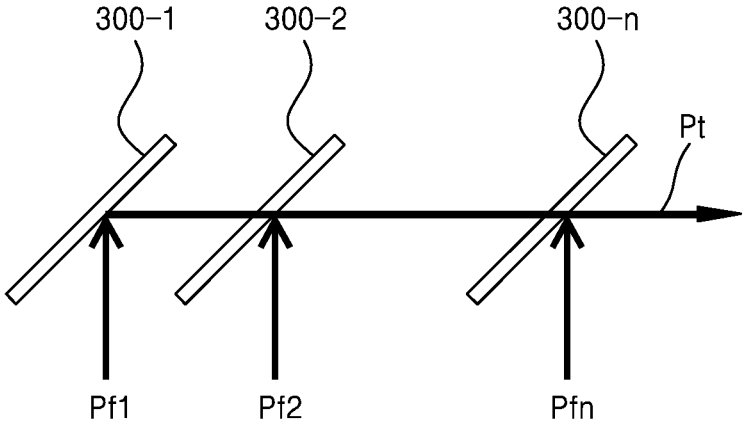
FIG. 15 is a conceptual view illustrating a process of combining plasma light having different wavelengths in accordance with exemplary embodiments of the present invention.

FIG. 15 is a conceptual view illustrating a process of combining plasma light having different wavelengths.

Referring to FIG. 15, a light source system according to exemplary embodiments of the present invention may combine plasma light Pf1, Pf2, . . . , and Pfn having different wavelengths by using a plurality of light-combining optical devices. For example, first through n-th light-combining optical devices 300-1, 300-2, . . . , and 300-*n* may be combined by the light source system. The first through n-th light-combining optical devices 300-1, 300-2, . . . , and 300-*n* may be, for example, dichroic mirrors that transmit or reflect light according to the wavelengths thereof. For example, the first light-combining optical device 300-1 may reflect the plasma light Pf1 having a first wavelength and may transmit light having other wavelengths. The second light-combining optical device 300-2 may reflect the plasma light Pf2 having a second wavelength and may transmit light having other wavelengths. Also, the n-th light-combining optical device 300-*n* may reflect the plasma light Pfn having an n-th wavelength and may transmit light having other wavelengths. Accordingly, the plurality of plasma lights Pf1, Pf2, . . . , and Pfn having the first through n-th wavelengths may be combined by the first through n-th light-combining optical devices 300-1, 300-2, . . . , and 300-*n* into one combined plasma light Pt.

Plasma light having one wavelength may be provided to the front of the first light-combining optical device 300-1 and may be transmitted through the first light-combining optical device 300-1. In this case, plasma light from n+1 independent sources may be combined by the n light-combining optical devices. Since the light source system combines plasma light from multiple independent sources, plasma light having high power and high brightness may be provided. However, in some semiconductor processes such as an exposure process or an inspection process, plasma light having a specific wavelength may be required. Accordingly, combined plasma light output from the light source system may be separated into plasma light having a specific wavelength by using an optical device such as a dichroic mirror or a beam splitter, and plasma light, so separated, may then be used in such a semiconductor process.

Figure 16:
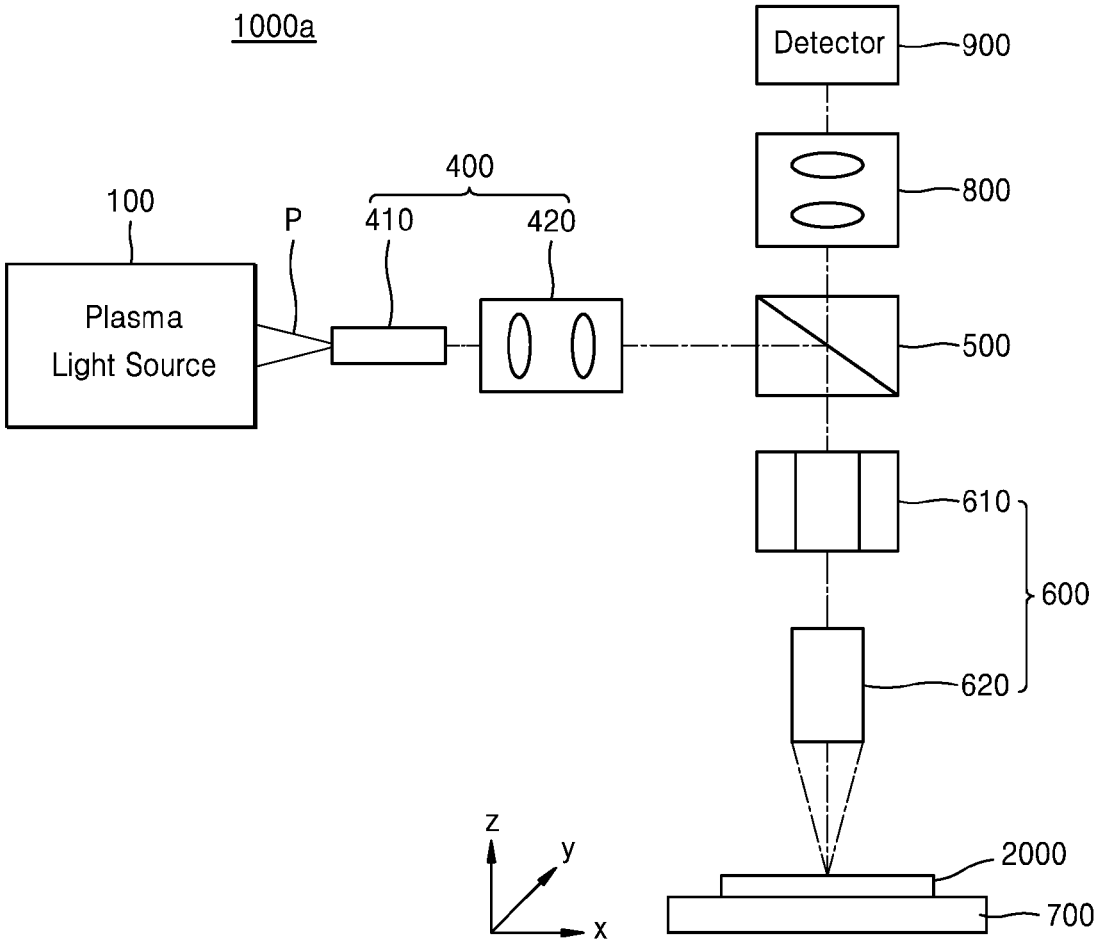
FIG. 16 is a view illustrating an inspection apparatus comprising a light source system including a plasma light source apparatus according to an exemplary embodiment of the present invention.

FIG. 16 is a schematic diagram illustrating an inspection apparatus 1000*a* embodied as a light source system including a plasma light source apparatus according to an exemplary embodiment of the present invention.

Referring to FIG. 16, the inspection apparatus 1000*a* according to an exemplary embodiment of the present invention may include the plasma light source apparatus 100, a first optical system 400, a beam splitter 500, a second optical system 600, an inspection stage 700, a third optical system 800, and a detector 900.

The plasma light source apparatus 100 may be the plasma light source apparatus 100 of FIGS. 1 through 2B. However, the inspection apparatus 1000*a* may include any of the plasma light source apparatuses 100*a*, 100*b*, . . . , 100*j*, and 100*k* of FIGS. 3 through 11 as well as the plasma light source apparatus 100 of FIGS. 1 through 2B. Also, the light source system 1000 of FIG. 12 may be used, instead of the plasma light source apparatus 100. For example, the combined plasma light Pt that is an output of the light source system 1000 of FIG. 12 may be used as the plasma light P of the inspection apparatus 1000*a*.

The first optical system 400 may be disposed between the plasma light source apparatus 100 and the beam splitter 500, and may collect the plasma light P from the plasma light source apparatus 100 and may transfer the plasma light P to the beam splitter 500. The first optical system 400 may include, for example, a rod lens 410 and a relay lens 420. However, the first optical system 400 is not limited thereto, and may include a variety of lenses to transfer the plasma light P to the beam splitter 500.

The beam splitter 500 may reflect the plasma light P transferred through the first optical system 400 to the second optical system 600, and may transmit light reflected by an object to be inspected 2000 through the second optical system 600 to the detector 900. The beam splitter 500 may correspond to, for example, a dichroic mirror.

The second optical system 600 may emit plasma light reflected by the beam splitter 500 to the object to be inspected 2000. The second optical system 600 may include, for example, a tube lens 610 and an objective lens 620. The tube lens 610 converts light from the beam splitter 500 into parallel light, and the object lens 610 collects the parallel light form the tube lens 610 and focuses the collected parallel light on the object to be inspected 2000.

The inspection stage 700, on which the object to be inspected 2000 is placed, may move in an x-direction, a y-direction, and a z-direction. Accordingly, the inspection stage 700 is referred to as an XYZ stage. The object to be inspected 2000 may be any of various devices to be inspected such as a wafer, a semiconductor package, a semiconductor chip, or a display panel.

Plasma light may be emitted to and reflected by the object to be inspected 2000, and the reflected light may pass back through the second optical system 600 and may be transferred to the beam splitter 500. The beam splitter 500 may allow the reflected light to pass therethrough and may transfer the reflected light to the third optical system 800. The third optical system 800 may transfer the reflected light received from the beam splitter 500 to the detector 900. The third optical system 800 may be, for example, a relay lens.

The detector 900 may receive the reflected light from the third optical system 800, and may transfer the received reflected light to another analysis apparatus (not shown) to analyze the reflected light. The detector 900 may optionally include the analysis apparatus or may interwork with the analysis apparatus to analyze the reflected light in real time. The detector 900 may be, for example, a charge-coupled device (CCD). However, the detector 900 is not limited to a CCD, and may be any of various other sensors such as a complementary metal-oxide-semiconductor (CMOS) image sensor.

Although the plasma light source apparatus 100 is included and used in the inspection apparatus in the above, exemplary embodiments of the present invention are not limited thereto, and the plasma light source apparatus 100 may be used in a semiconductor processor, for example, an exposure process. Accordingly, the plasma light source apparatus 100 may be included in an exposure apparatus.

As described above, a plasma light source apparatus according to exemplary embodiments of the present inventive concept may ignite plasma by using a first laser, and may maintain the plasma and may increase an intensity of the plasma by using a second laser. The plasma may be ignited and maintained in a chamber having a relatively large space. Accordingly, problems occurring when plasma is formed in a narrow bulb-type lamp formed of quartz may be solved.

Also, the plasma light source apparatus according to exemplary embodiments of the present inventive concept may use a chamber in which two curved mirrors are coupled to each other such that the two curved mirrors face each other. The plasma light source apparatus may efficiently collect a laser beam for generating and maintaining plasma to the chamber and may efficiently collect and discharge from the chamber, plasma light having high brightness. Accordingly, due to the efficient collecting of plasma light, the plasma light source apparatus may have high efficiency and high brightness.

While the inventive concept has been particularly shown and described with reference to exemplary embodiments thereof, it will be understood that various changes in form and details may be made.

What is claimed is:

1. A plasma light source apparatus comprising:

a first laser generator configured to generate a first laser beam;

a second laser generator configured to generate a second laser beam; and a sealed chamber with a medium material disposed therein, the chamber having a surface comprising two curved mirrors, wherein plasma is generated in the chamber by igniting the medium material with the first laser beam and maintaining the ignited state of the medium material with the second laser beam.

2. The plasma light source apparatus of claim 1, wherein the two curved mirrors are a spherical mirror and an elliptical mirror, respectively, wherein a spherical center of the spherical mirror, which is a center of curvature of the spherical mirror, is identical to a focal point closest to the elliptical mirror from among two focal points of the elliptical mirror.

3. The plasma light source apparatus of claim 2, wherein the first laser beam and the second laser beam are directed to the focal point closest to the elliptical mirror through a first lens array that is located in front of the chamber, or are directed to the focal point closest to the elliptical mirror via reflection, by the spherical mirror or the elliptical mirror, through a second lens array that is located in front of the chamber.

4. The plasma light source apparatus of claim 2, wherein plasma light generated by the plasma exits the chamber via reflection by the spherical mirror or the elliptical mirror.

5. The plasma light source apparatus of claim 1, wherein the two curved mirrors are a first elliptical mirror and a second elliptical mirror, respectively, among two focal points of the first elliptical mirror, a focal point closest to the first elliptical mirror is a first focal point and a focal point farthest from the first elliptical mirror is a second focal point, among two focal points of the second elliptical mirror, a focal point closest to the second elliptical mirror is a third focal point and a focal point farthest from the second elliptical mirror is a fourth focal point, and the first focal point of the first elliptical mirror is identical to the fourth focal point of the second elliptical mirror and the second focal point of the first elliptical mirror is identical to the third focal point of the second elliptical mirror, wherein the first laser beam and the second laser beam are directed to at least one of the first focal point and the second focal point, without being reflected thereto, or are directed to at least one of the first focal point and the second focal point via reflection by the first elliptical mirror or the second elliptical mirror.

6. The plasma light source apparatus of claim 5, wherein plasma light generated by the plasma exits the chamber via reflection by the first elliptical mirror or the second elliptical mirror.

7. The plasma light source apparatus of claim 1, wherein the first laser beam enters the chamber via a first inlet, the second laser beam enters the chamber via a second inlet, and the plasma light exists the chamber via an outlet, wherein at least one of the two curved mirrors is a dichroic mirror, and wherein the first inlet is identical to the second inlet and different from the outlet, the first inlet is identical to the outlet and different from the second inlet, or the second inlet is identical to the outlet and different from the first inlet.

8. The plasma light source apparatus of claim 1, further comprising a cooling device surrounding an outer surface of the chamber and comprising a path through which a cooling gas flows, wherein the cooling device is configured such that the cooling gas flows from a top of the chamber to a bottom of the chamber, and wherein the top and bottom of the chamber are defined relative to gravity.

9. The plasma light source apparatus of claim 8, wherein the cooling device comprises at least one of an air gun configured to inject the cooling gas into an upper portion of the chamber and an air guide configured to guide the cooling gas such that the cooling gas flows adjacent to the chamber.

10. A light source system comprising:

at least two plasma light source apparatuses each configured to generate plasma light from plasma; and a light-combining optical device configured to combine plasma light output from each of the at least two plasma light source apparatuses, wherein each of the at least two plasma light source apparatuses comprises a chamber configured to accommodate and seal a medium material therein, the chamber having an inner surface comprising two curved mirrors, and wherein plasma is generated in the chamber by igniting the medium material with a first laser beam and maintaining the ignited state of the medium material with a second laser beam distinct from the first laser beam.

11. The light source system of claim 10, wherein the light-combining optical device is a rod lens having at least two curved surfaces, a dichroic mirror, or a beam splitter.

12. The light source system of claim 10, wherein the two curved mirrors are a spherical mirror and an elliptical mirror, respectively, wherein a spherical center of the spherical mirror is identical to a focal point closest to the elliptical mirror from among two focal points of the elliptical mirror, wherein the first laser beam and the second laser beam are directed to the focal point, without being reflected thereto, or are directed to the focal point via reflection by the spherical mirror or the elliptical mirror, wherein plasma light generated by the plasma exits the chamber via reflection by the spherical mirror or the elliptical mirror.

13. The light source system of claim 10, wherein the two curved mirrors are a first elliptical mirror and a second elliptical mirror, respectively, wherein each of the first elliptical mirror and the second elliptical mirror has two focal points, wherein the first laser beam and the second laser beam are directed to one of the two focal points, without being reflected thereto, or are input to at least one of the two focal points via reflection by the first elliptical mirror or the second elliptical mirror, wherein plasma light generated by the plasma exits the chamber via reflection by the first elliptical mirror or the second elliptical mirror.

14. The light source system of claim 10, wherein each of the at least two plasma light source apparatuses further comprises a cooling device surrounding an outer surface of the chamber, and a path through which a cooling gas flows, wherein the cooling device is configured such that the cooling gas flows from a top of the chamber to a bottom of the chamber, and wherein the top and bottom of the chamber are defined relative to gravity.

15. The light source system of claim 10, further comprising:

a movable inspection stage configured to receive an object to be inspected;

a beam splitter configured to reflect or transmit light exiting the light-combining optical device and transmit or reflect light reflected from the object to be inspected;

a first optical system configured to direct light exiting the light-combining optical device to the beam splitter;

a second optical system configured to direct light from the beam splitter to the object to be inspected and to direct light reflected from the object to be inspected to the beam splitter; and a detector configured to receive light directed to the detector through the beam splitter.

16. A method for generating plasma light, comprising:

directing a first laser beam into a sealed chamber comprised of two curved mirrors;

igniting plasma in the chamber using the first laser beam;

directing a second laser beam, different from the first laser beam, into the chamber;

maintaining the ignited plasma in the chamber using the second laser beam; and directing light generated by the plasma outside of the chamber.

17. The method of claim 16, wherein, the two curved mirrors curve outwardly with respect to each other.

18. The method of claim 16, wherein the first laser beam and the second laser beam are directed into the chamber via a window disposed within one of the two curved mirrors.

19. The method of claim 16, wherein the plasma is ignited in the chamber by an exposure of a medium material sealed therein by the first laser beam.

20. The method of claim 16, wherein the first laser beam and the second laser beam are directed into the chamber by a lens array that is located outside of the chamber.

* * * * *